US007878584B2

(12) United States Patent
Hu et al.

(10) Patent No.: US 7,878,584 B2
(45) Date of Patent: Feb. 1, 2011

(54) SAFETY BELT STORAGE ASSEMBLY AND CHILD SEAT HAVING THE SAME

(75) Inventors: Jun-Jie Hu, Central (HK); Wen-Qu Hu, Central (HK); Zheng-Wen Guo, Central (HK)

(73) Assignee: Wonderland Nurserygoods Company Limited, Central (HK)

( * ) Notice: Subject to any disclaimer, the term of this patent is extended or adjusted under 35 U.S.C. 154(b) by 34 days.

(21) Appl. No.: 12/486,746

(22) Filed: Jun. 17, 2009

(65) Prior Publication Data

US 2009/0315375 A1 Dec. 24, 2009

Related U.S. Application Data

(60) Provisional application No. 61/074,129, filed on Jun. 19, 2008, provisional application No. 61/091,724, filed on Aug. 25, 2008, provisional application No. 61/140,973, filed on Dec. 28, 2008, provisional application No. 61/154,774, filed on Feb. 24, 2009.

(51) Int. Cl.
*A47B 83/02* (2006.01)
*A47C 7/62* (2006.01)

(52) U.S. Cl. ..... 297/148; 297/149; 297/153; 297/188.01; 297/188.08; 297/188.12; 297/188.13

(58) Field of Classification Search ..... 297/148, 297/149, 150, 151, 152, 153, 154, 155, 188.08, 297/188.09, 188.1, 188.11, 188.12, 188.13, 297/481

See application file for complete search history.

(56) References Cited

U.S. PATENT DOCUMENTS

| | | | | |
|---|---|---|---|---|
| 4,291,915 | A * | 9/1981 | Cox | 297/188.1 X |
| 6,237,996 | B1 | 5/2001 | Chen | |
| 6,390,345 | B1 * | 5/2002 | Brown et al. | 297/188.09 X |
| 6,773,064 | B2 * | 8/2004 | Treen et al. | 297/153 X |
| 7,300,103 | B1 * | 11/2007 | Grays | 297/188.1 X |

FOREIGN PATENT DOCUMENTS

| | | |
|---|---|---|
| DE | 1 002 513 | 2/1957 |
| EP | 1 277 423 A1 | 1/2003 |
| EP | 1 574 389 A1 | 9/2005 |
| WO | 2006130906 A1 | 12/2006 |

* cited by examiner

*Primary Examiner*—Rodney B White
(74) *Attorney, Agent, or Firm*—Winston Hsu; Scott Margo

(57) ABSTRACT

When a safety belt storage assembly's storage is mounted to a main body of a child seat, the storage of the safety belt storage assembly may be selectively configured between an opened state and a closed state. When the storage of the safety belt storage assembly is configured at the opened state, a safety belt set stored within the housing can be taken out and further used to fasten the child seat to an adult chair. The opened state storage further prevents the child seat from mounting on a frame body. When the safety belt set is stored in the housing, the storage of the safety belt storage assembly can be configured to the closed state and the child seat is allowed to be mounted to the frame body.

21 Claims, 22 Drawing Sheets

SAFETY BELT STORAGE ASSEMBLY AND CHILD SEAT HAVING THE SAME

CROSS REFERENCE TO RELATED APPLICATIONS

This application claims the benefits of U.S. Provisional Applications No. 61/074,129, which was filed on Jun. 19, 2008, No. 61/091,724, which was filed on Aug. 25, 2008, No. 61/140,973, which was filed on Dec. 28, 2008, and No. 61/154,774, which was filed on Feb. 24, 2009, and are incorporated herein by reference.

BACKGROUND OF THE INVENTION

1. Field of the Invention

The invention relates to a safety belt storage assembly, and more particularly, to a safety belt storage assembly used for a child seat and the child seat having the same.

2. Description of the Prior Art

To enhance a child seat with multiple functions, there are some child seats used to place on an adult chair to function as a booster. Such booster type child seat is required to provide proper fastening device to securely attach the child seat to the adult chair to prevent child from falling off. Safety belts or straps are commonly used as the fastening device that can wrap around the main body of the child seat and the adult chair and fix them together, while in other cases, the child seat may have its own safety belts, one set wrapping backward around the backrest of the adult chair, and another set wrapping downward around the seat of the adult chair so as to secure the child seat to the adult chair. Such conventional child seats, however, do not have devices to store the unused safety belts. Without suitable storage device, the safety belts have great chances to get lost, or more seriously, may cause safety issues like strangling the child.

SUMMARY OF THE INVENTION

The invention provides a safety belt storage assembly that includes a housing, a cover, and a safety belt set. The housing includes a space and an opening. The cover is mounted to the housing and movable relative to the housing between an opened position and a closed position that covers the opening. The safety belt set is mounted to the housing and stored in the space when the cover is configured at the closed position. The safety belt set is capable of reaching out of the space through the opening when the cover is configured at the opened position.

The invention also provides a child seat detachably mounted to a frame body. The child seat includes a storage and a safety belt set. The storage includes a space and is convertible between a closed state and an opened state. When the child seat is mounted to the frame body, the storage is at the closed state and the safety belt set is stored in the space, and when the child seat is detached from the frame body, the storage is moved to the opened state such that the child seat is capable of fastening to an adult chair via the safety belt set.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
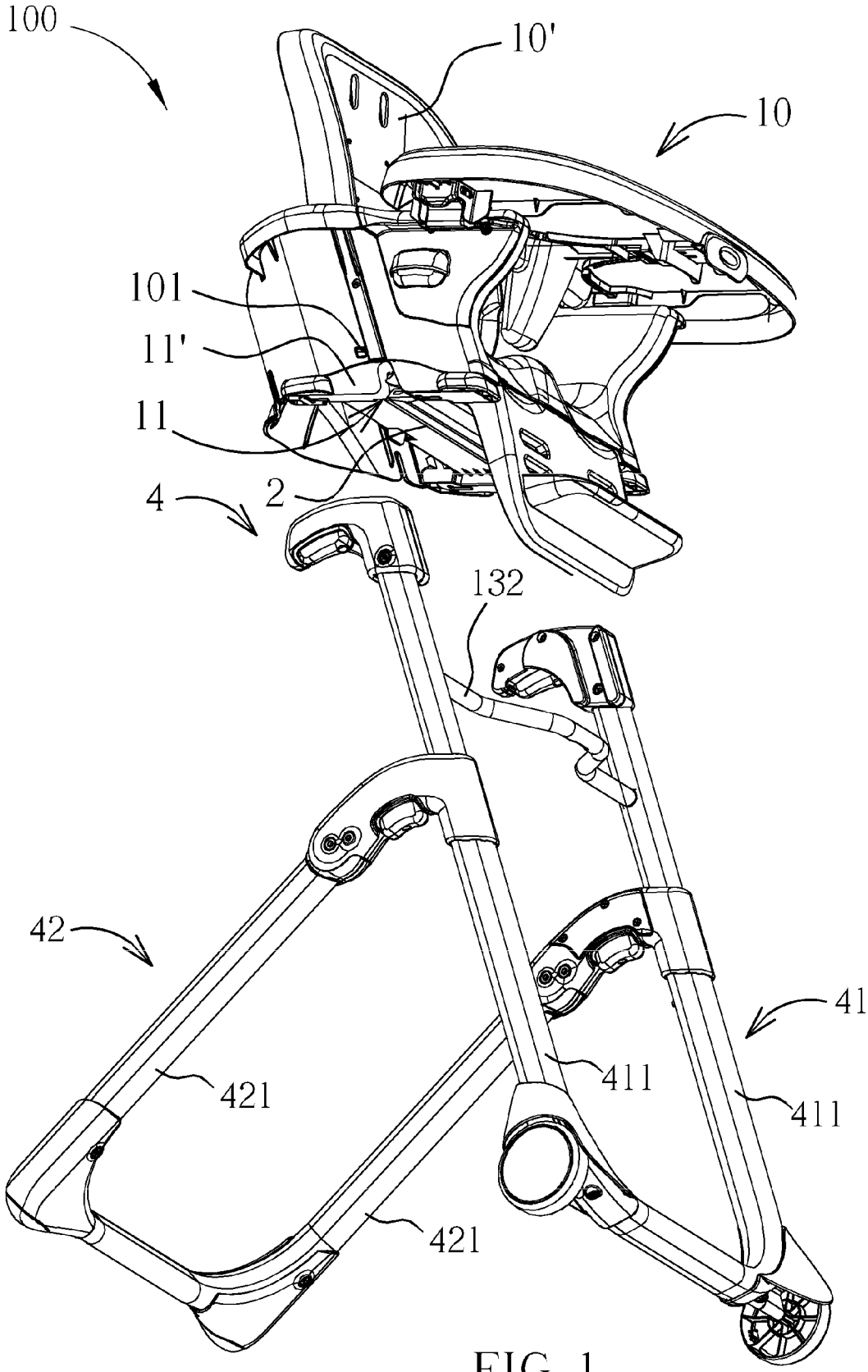
FIG. 1 is a schematic diagram of a high chair that includes a safety belt storage assembly according to a first embodiment of the present invention.

Please refer to FIG. 1. FIG. 1 shows a schematic diagram of a high chair 100 that includes a safety belt storage assembly 2 according to a first embodiment of the present invention. The high chair 100 includes a child seat 10 and a frame body 4. The frame body 4 includes a front leg frame 41 and a rear leg frame 42 that rotatably connects to the front leg frame 41. The front leg frame 41 includes a pair of front legs 411, the rear leg frame 42 includes a pair of rear legs 421, and a supporting frame 132 is mounted between the pair of front legs 411. The child seat 10 is mounted to the frame body 4 in a detachable way and when the child seat 10 is detached from the frame body 4, the child seat 10 can be used as a stand-alone product, for instance, as a booster to place and fasten to an adult chair. The child seat 10 includes a safety belt storage assembly 2 that has a space therein, such as the space 210 in FIG. 2, which can store a safety belt set. The safety belt storage assembly 2 may be converted between an opened state and a closed state as needed. The child seat 10 also includes a main body 10' and two feet 11' locating under two sides of the main body 10' respectively. Each foot 11' includes a seat coupling device 11, where the safety belt storage assembly 2 is configured between the two seat coupling devices 11. When the child seat 10 is mounted to the frame body 4, the seat coupling devices 11 are engaged with the supporting frame 132 of the frame body 4 such that the assembly is set up as the high chair 100.

Figure 2:
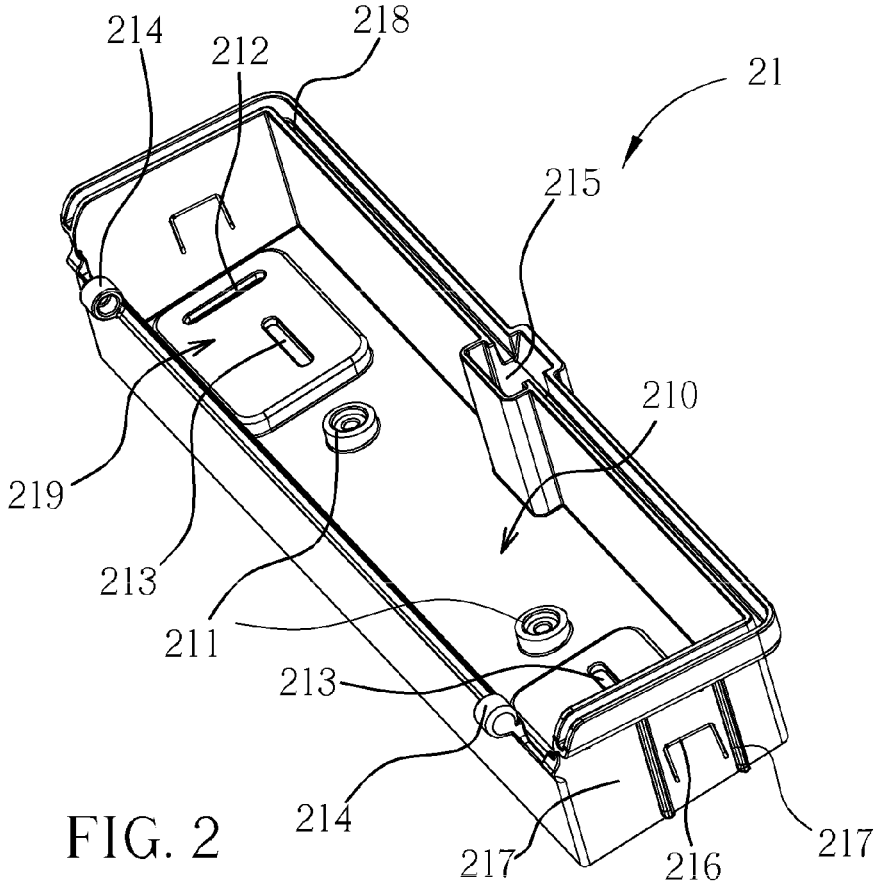
FIG. 2 is a schematic diagram of a housing of the safety belt storage assembly according to the first embodiment of the present invention.
Figure 3:
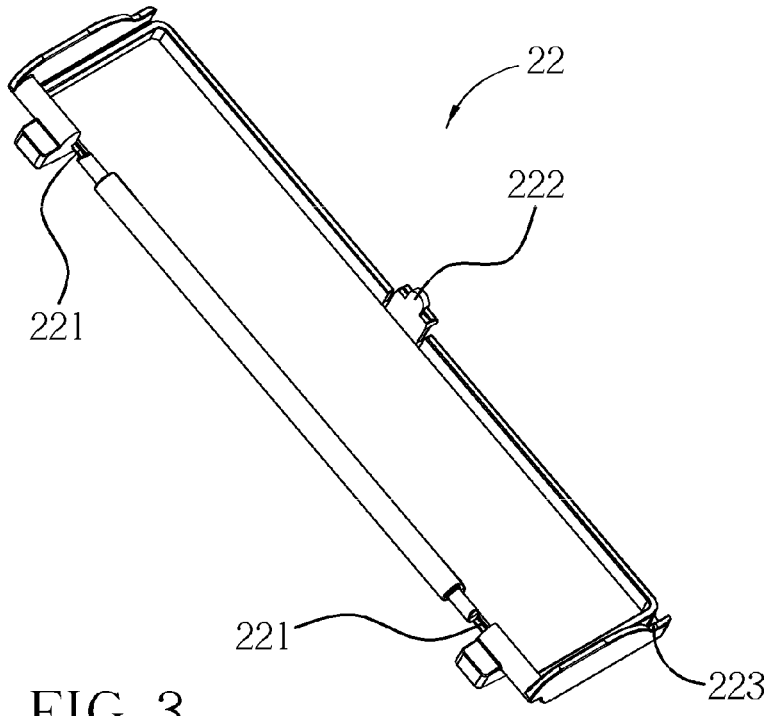
FIG. 3 is a schematic diagram of a cover of the safety belt storage assembly.
Figure 4:
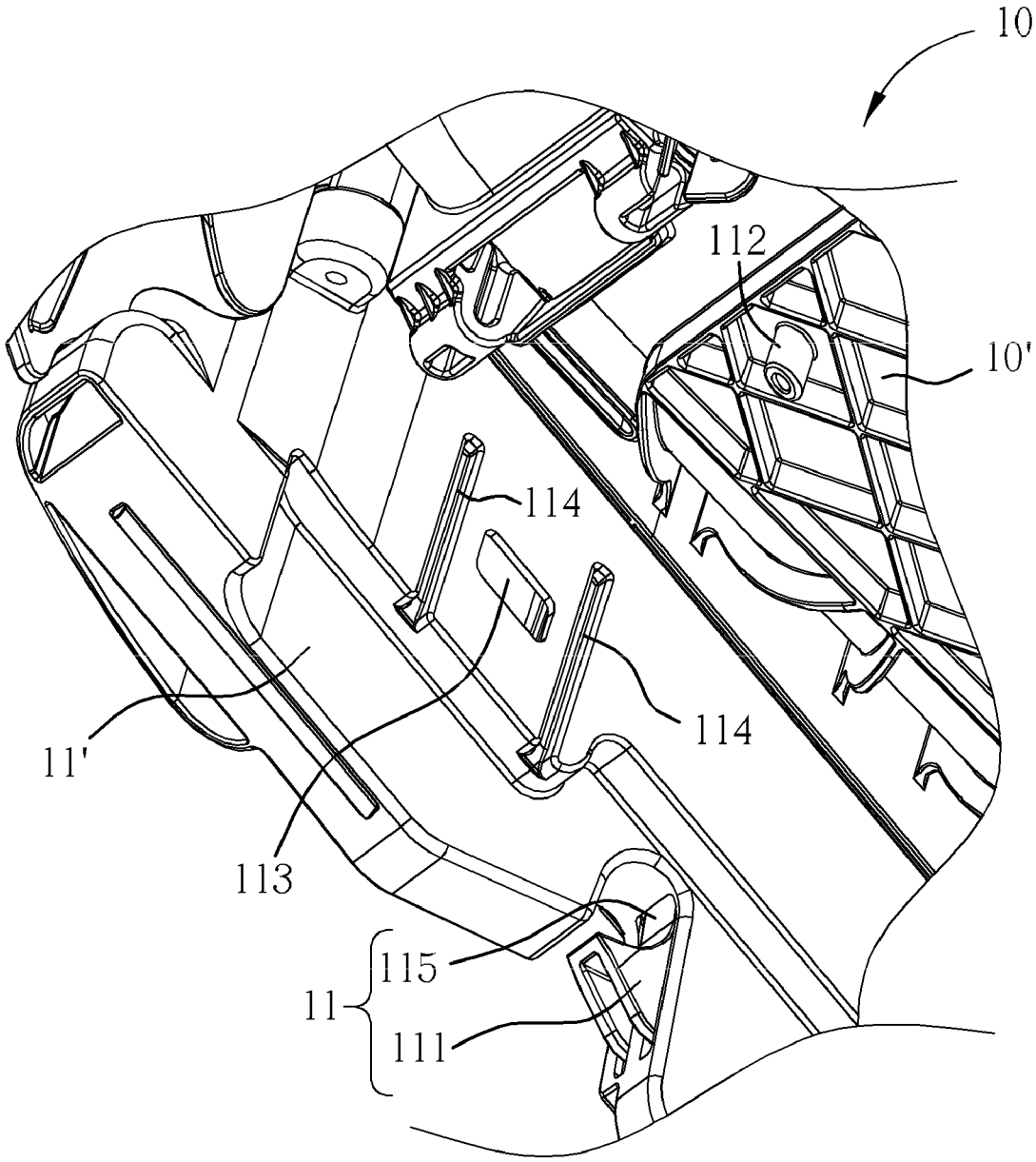
FIG. 4 is a schematic diagram of the partial bottom view of a child seat.
Figure 5:
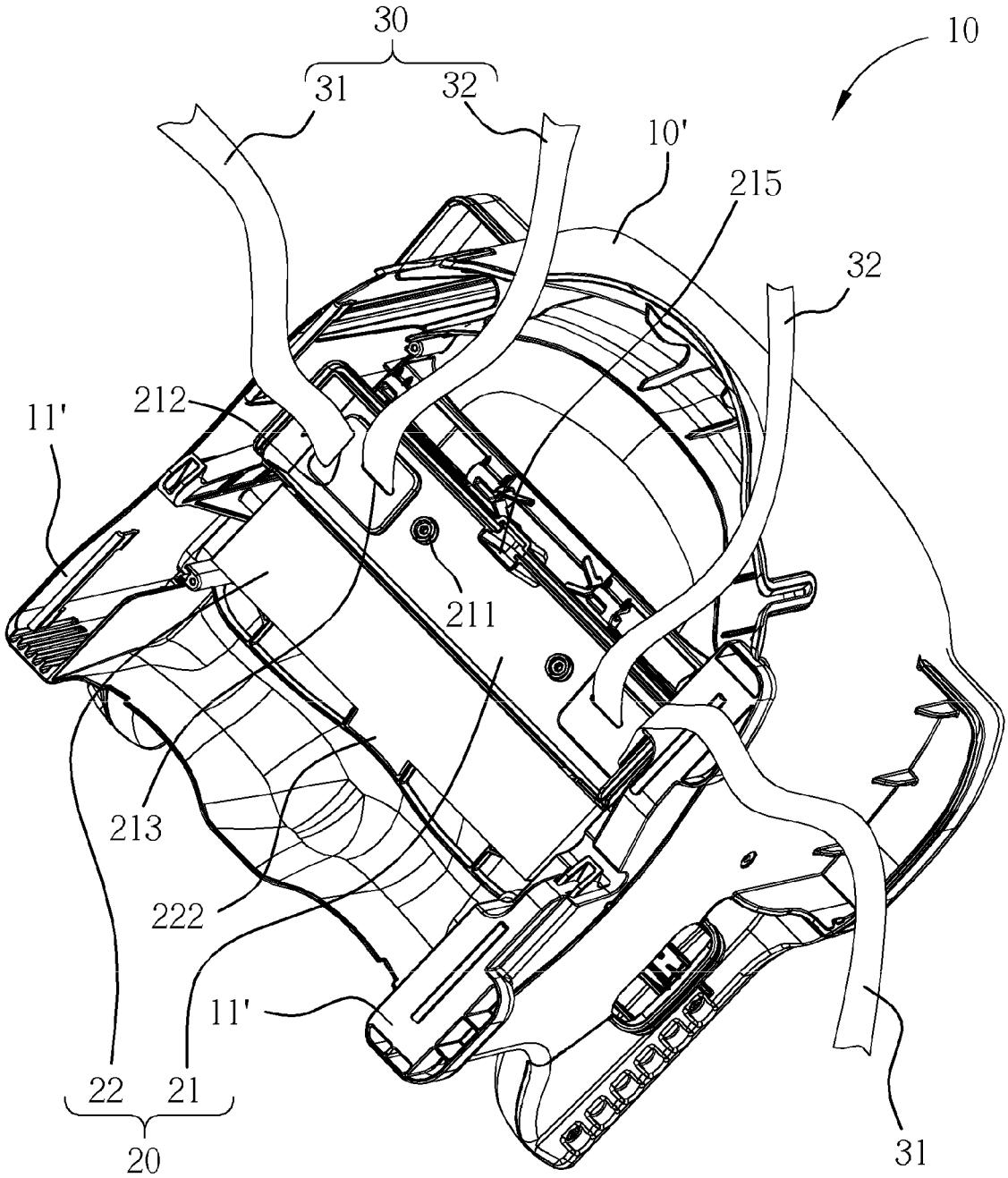
FIG. 5 is a schematic diagram of the bottom view of the child seat showing the storage of the safety belt storage assembly at an opened state.
Figure 6:
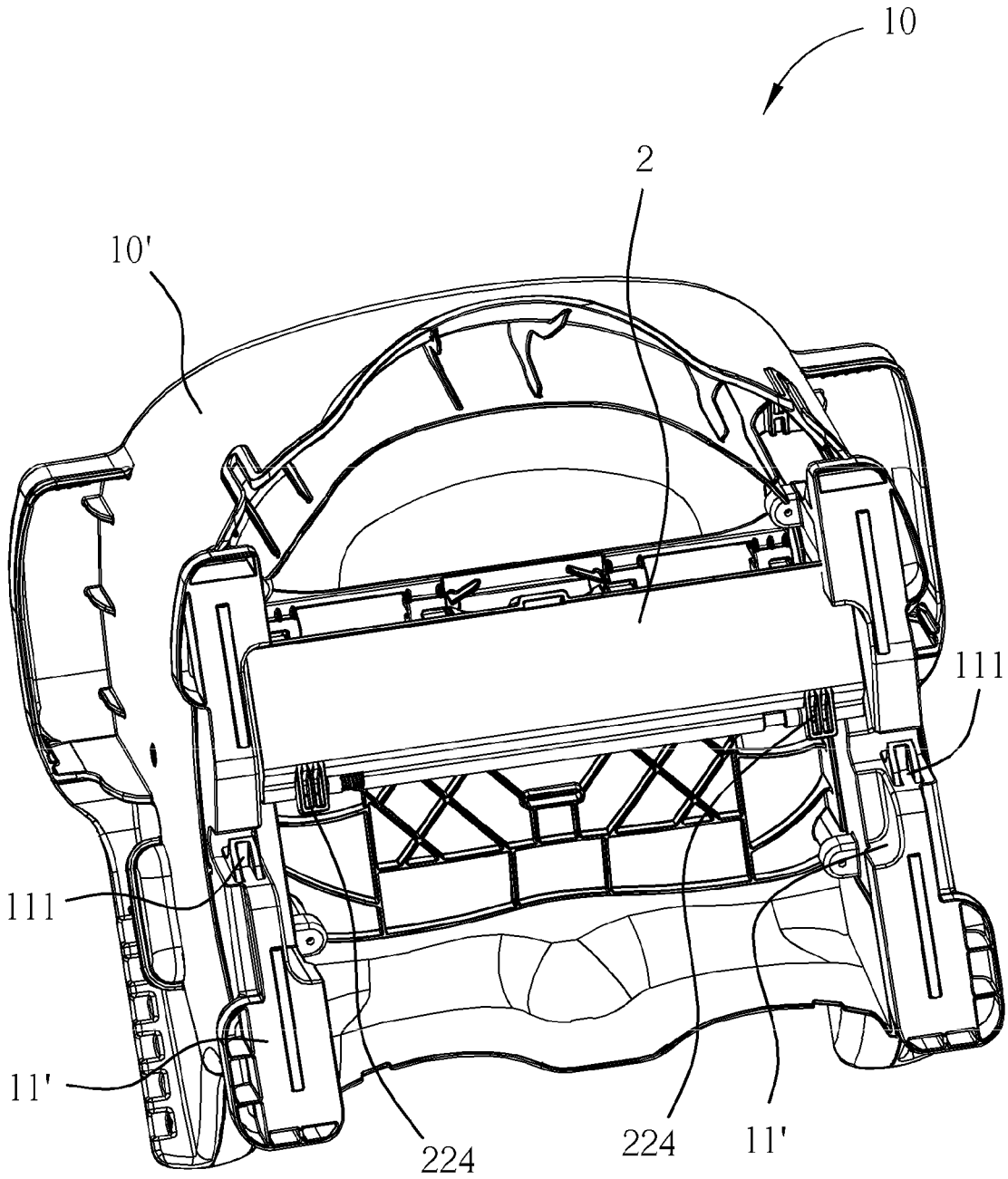
FIG. 6 is a schematic diagram of the bottom view of the child seat showing the storage of the safety belt storage assembly at a closed state.

Please refer to FIG. 2 to FIG. 6. FIG. 2 is a schematic diagram of a housing 21 of the safety belt storage assembly 2 according to the first embodiment of the present invention, FIG. 3 is a schematic diagram of a cover 22 of the safety belt storage assembly 2, FIG. 4 is a schematic diagram of the partial bottom view of the child seat 10, FIG. 5 is a schematic diagram of the bottom view of the child seat 10 showing the storage of the safety belt storage assembly 2 at an opened state, and FIG. 6 is a schematic diagram of the bottom view of the child seat 10 showing the storage of the safety belt storage assembly 2 at a closed state. Please refer to FIG. 2, FIG. 4, and FIG. 5. The seat coupling device 11 is configured at the foot 11' of the child seat 10 and includes a roughly hook-shaped coupler 111 and an engaging recess 115. The seat coupling device 11 may have engagement with the supporting frame 132 so as to detachably mount the child seat 10 to the frame body 4.

In this embodiment, the safety belt storage assembly 2 is configured between the feet 11' and near the seat coupling devices 11 at both sides of the child seat 10. The safety belt storage assembly 2 includes a storage 20 and a safety belt set 30, which is mounted to the storage 20. The storage 20 may be a square or a rectangular container that includes a housing 21 and a cover 22 mounted to the housing 21 and moveable relative to the housing 21 rotatably. The safety belt set 30 includes a first safety belt set 31 and a second safety belt set 32 and they are shown in FIG. 5. The housing 21 has ribs 217 and a first coupling portion 216 at two side walls, and the bottom of the housing 21 has two first slots 212 and two second slots 213 perpendicular to each first slot 212. To mount the housing 21 to the bottom of a main body 10' of the child seat 10, the ribs 217 are matched with the guiding tracks 214 of the feet 11'. The housing 21 may be guided to mount to the feet 11' all the way along the guiding tracks 214 until the first coupling portions 216 at both sides of the housing 21 engage with the second coupling portions 213 at the feet 11' respectively. When the housing 21 is mounted to the bottom of the main body 10' as shown in FIG. 5, some rivets or screws (not shown in the figure) may further be used to secure the storage 20 at the bottom of the main body 10' by passing through installing slots 211 on the housing 21 and installing slots 112 at the bottom of the main body 10'.

Please refer to FIG. 2, FIG. 3, and FIG. 5. Two pivot shafts 221 protrude on the cover 22 and corresponding pivot openings 214 are configured at the housing 21. Each pivot shaft 221 on the cover 22 inserts into corresponding pivot opening 214 to form as an axle. With the pivot openings 214 and the pivot shafts 221, the cover 22 pivotally mounts to the housing 21, and moves relative to the housing 21 between an opened position as shown in FIG. 5 and a closed position as shown in FIG. 6. A torsion spring 23 may be configured between the pivot opening 214 of the housing 21 and the pivot shaft 221 of the cover 22. The housing 21 has an opening 219 and forms a space 210 inside. The first safety belt set 31 includes two straps. One end of each strap passes through the corresponding first slot 212 and is secured therein, and the other ends of the straps couple to each other via a male buckle and a female buckle. The second safety belt set 32 also includes two straps. One end of each strap passes through the corresponding second slot 213 and is secured therein, and the other ends of the straps couple to each other via a male buckle and a female buckle. Since the first slot 212 and the second slot 213 at the bottom of the housing 21 are perpendicular to each other, the two straps of the first safety belt set 31 are also secured perpendicularly to each other to the bottom of the housing 21. In other embodiments, the first and the second safety belt sets 31, 32 need not necessarily be perpendicular to each other. It may be deployed in the housing 21 unparallel, as long as the first safety belt set 31 and the second safety belt set 32 are friendly to be accessed and used.

Figure 7:
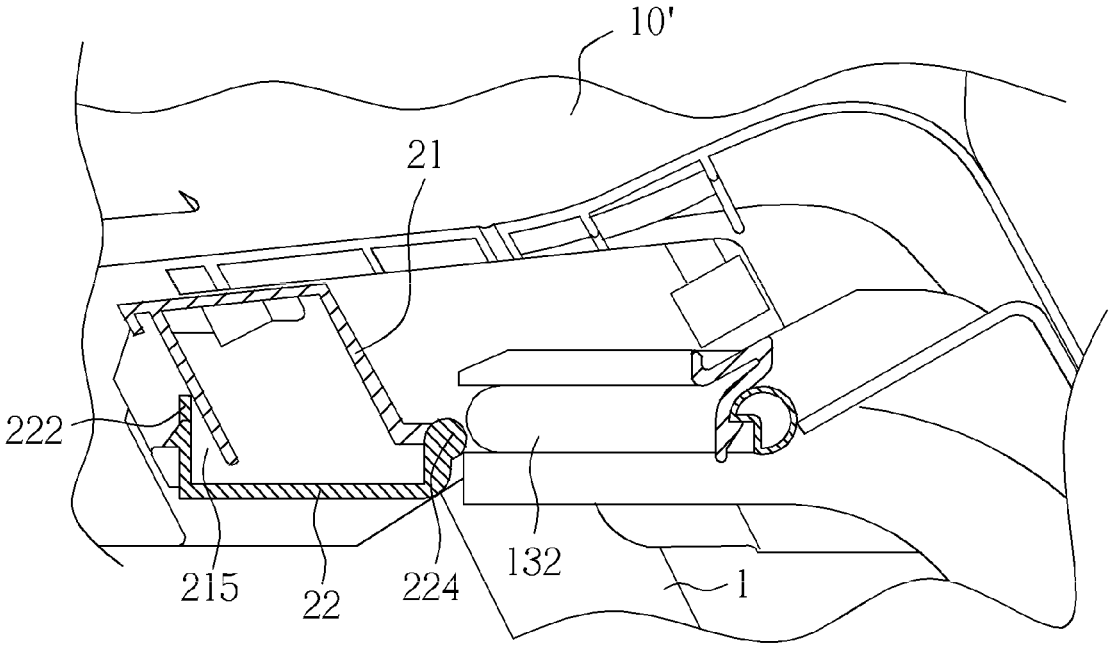
FIG. 7 is a schematic diagram of a side cross-sectional view of the child seat mounted to the frame body.

When the cover 22 pivots relative to the housing 21 to the closed position as shown in FIG. 6, the cover 22 covers the opening 219 of the housing 21 and is kept at the closed position by a coupling portion 222 on the cover 22 engaging with a coupling slot 215 of the housing 21; meanwhile, the torsion spring 23 between the housing 21 and the cover 22 is deformed by the cover 22. At this state, the first safety belt set 31 and the second safety belt set 32 are stored within the housing 21. When the storage 20 of the safety belt storage assembly 2 is configured at the closed state, i.e., the first safety belt set 31 and the second safety belt set 32 are both stored in the space 210 of the housing 21, the child seat 10 may be mounted to the supporting frame 132 shown in FIG. 1 and the engaging recess 115 of the foot 11 is coupled with the supporting frame 132. The coupler 111 of the foot 11 is kept at a locking position in order to prevent removing the child seat 10 from the supporting frame 132. As the child seat 10 is securely mounted to the frame body 4, the child seat 10 and the frame body 4 together serve as the high chair 100. In this state, the supporting frame 132 of the frame body 4 further abut against a protruding edge 224 on the cover 22, shown in FIG. 7, that may further retain the cover 22 at the closed position so that the cover 22 is unpivotable relative to the housing 21. The first safety belt set 31 and the second safety belt set 32 is ensured to be stored within the storage 20 and will not fall out accidentally when the child seat 10 is mounted to the frame body 4.

Please keep on referring to FIG. 2 and FIG. 5. When the child seat 10 is used as a booster for older child that is put on an adult chair (such as the adult chair 1 in FIG. 21), the coupler 111 of the child seat 10 may be unlocked and the child seat 10 can be detached from the frame body 4, the coupling portion 222 of the cover 22 is pressed to disengage from the coupling slot 215 of the housing 21, and the torsion spring 23 biases the cover 22 relative to the housing 21 to the opened position as shown in FIG. 5, whereas in other embodiments, the cover 22 may also be biased by the torsion spring 23 to a certain angle and further be pushed to the opened position by a user. Since the cover 22 no longer covers the opening 219 of the housing 21, the first safety belt set 31 and the second safety belt set 32 previously stored in the space 210 may be taken out from the space 210 and reaching out of the housing 21 through the opening 219. The two straps of the first safety belt set 31 may wrap downward around the adult chair 1 and connect to each other via the male and female buckles. The two straps of the second safety belt set 32 may wrap backward around the adult chair 1 and connect to each other via the male and female buckles. The feet 11' at the bottom of the child seat 10 further function as a support and provide the height for the child seat 10.

Additionally, when the storage 20 of the safety belt storage assembly 2 is configured at the opened state as shown in FIG. 5, the cover 22 locates right at the path where the seat coupling device 11 is coupled with the supporting frame 132 of the frame body 4, i.e., the cover 22 blocks off the engaging recess 155 and ensures that the child seat 10 is prevented from mounting to the supporting frame 132 before the cover 22 completely moves to the closed position as shown in FIG. 6. The housing 21 also has a ditch 218 at the perimeter of the opening 219 that is matched with a protrusion 223 of the cover 22 while cover 22 is at the closed position relative to the housing 21 and covers the opening 219. If the first safety belt set 31 and the second safety belt set 32 are reaching out of the housing 21 or in other words, locating right between the ditch 218 and the protrusion 223 when the storage 20 is set at the opened state as shown in FIG. 5, the cover 22 is not allowed to move to the closed position as in FIG. 6 unless the first safety belt set 31 and the second safety belt set 32 are all stored in the space 210 of the housing 21. Such design of the ditch 218 and the protrusion 223 according to the first embodiment of the present invention ensures that the cover 22 can not be closed relative to the housing 21 without completely storing the first safety belt set 31 and the second safety belt set 32 in the housing 21 first. It can supply safety and prevent accident from happening when the first and the second safety belt sets 31, 32 are still reaching out of the housing 21 and the cover 22 is closed mistakenly. On the other hands, when the safety belt sets 31, 32 are reaching out of the housing 21 for use, the child seat 10 can only be used as a booster, not allowed to be mounted to the frame body 4. It provides safety when the child seat 10 is configured in different function mode.

Figure 8:
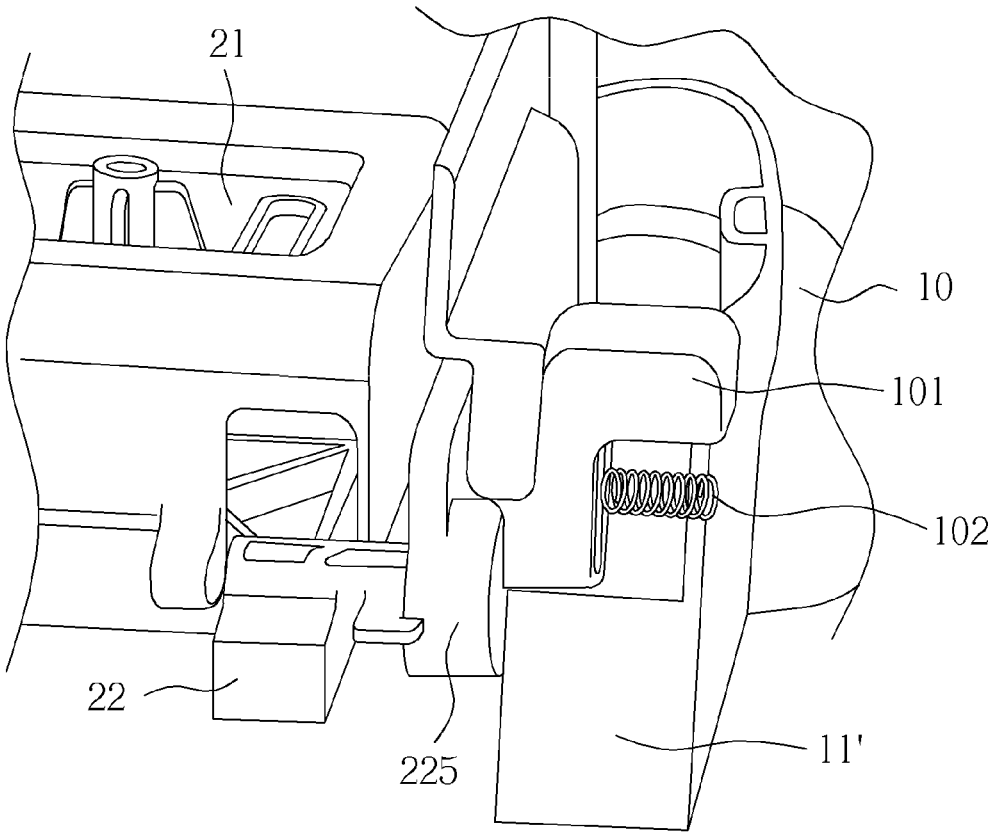
FIG. 8 is a schematic diagram showing a blocker of an anti-pseudo-engaging device retracting inside the foot.
Figure 9:
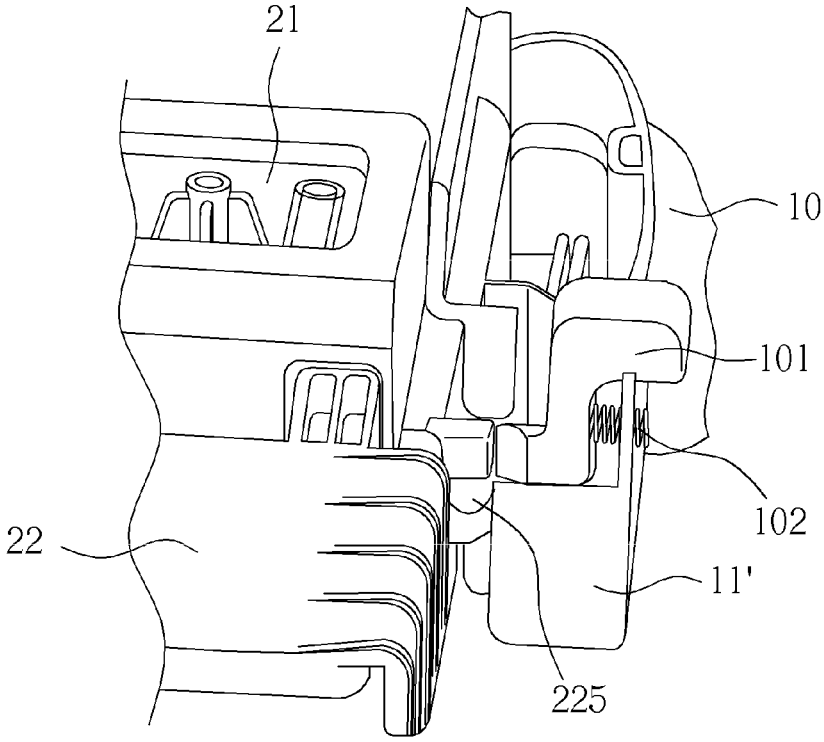
FIG. 9 is a schematic diagram showing the blocker of the anti-pseudo-engaging device reaching out of the foot.
Figure 10:
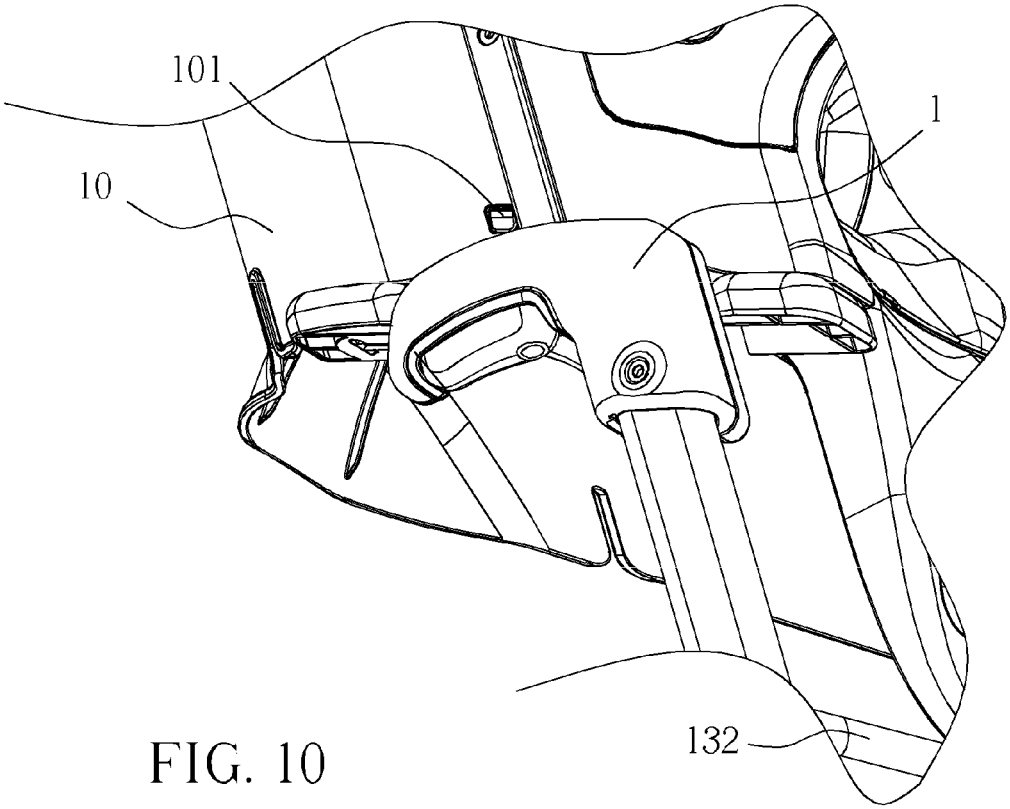
FIG. 10 is a schematic diagram showing the blocker withstanding the frame body to inhibit the child seat from mounting to the frame body.

Please refer to FIG. 1, FIG. 8, FIG. 9, and FIG. 10. To further prevent the child seat 10 from accidentally mounting to the frame body 4 before the storage 20 is set to the complete closed state, an anti-pseudo-engaging device may further disposed at the child seat 10. FIG. 1, FIG. 8, and FIG. 9 show one of the two feet 11' at both sides of the main body 10' of the child seat 10 that further includes a spring device 102 and a blocker 101 slidably mounted in the foot 11'. The cover 22 of the storage 20 has a cam portion 225 at the outer sidewall of the cover 22. The blocker 101 abuts against the cam portion 225 with its one end and retractable into the foot 11' with the other end. FIG. 9 and FIG. 10 show that the blocker 101 is extending out of the foot 11'. The spring device 102 mounts between the foot 11' and the blocker 101 and biases the blocker 101. The foot 11' of the child seat 10 has inner wall that guides the blocker 101 to slide along the foot 11'.

Figure 11:
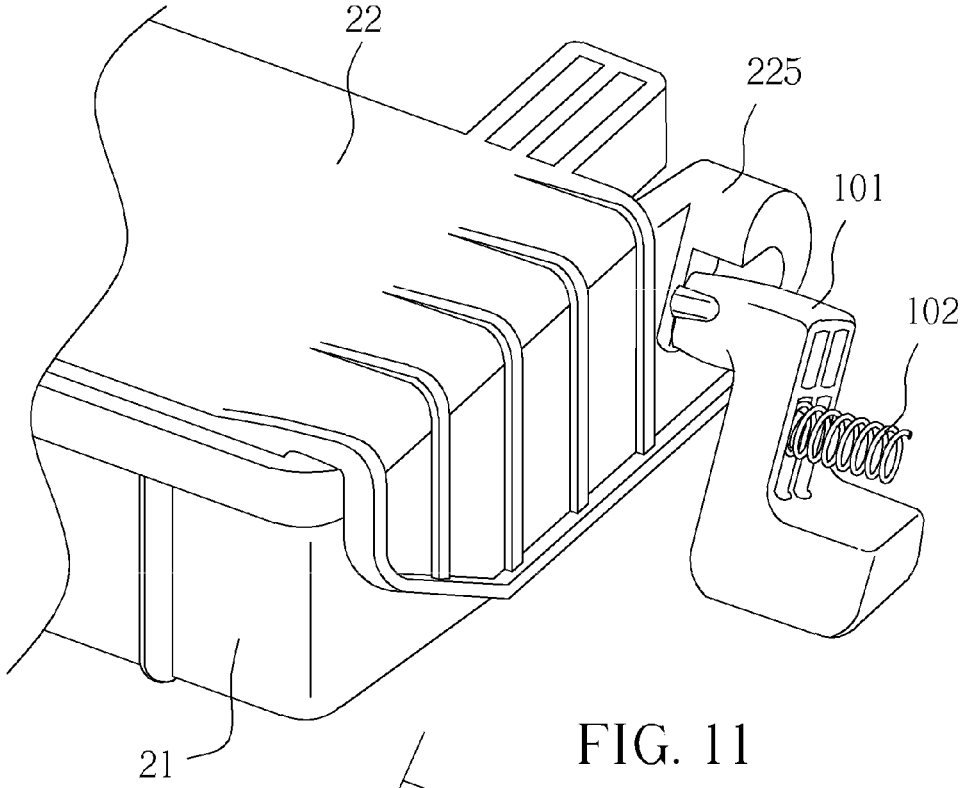
FIG. 11 is a schematic diagram of the blocker being biased by a spring device toward a cam portion and retracting inside the foot.
Figure 12:
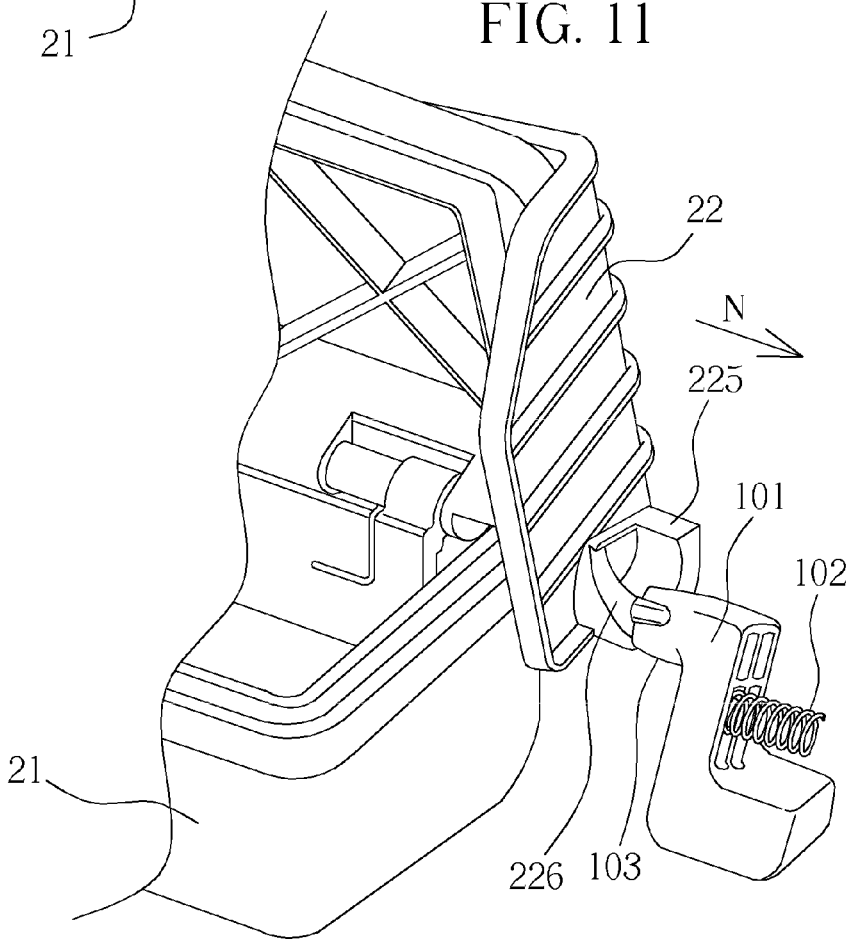
FIG. 12 is a schematic diagram of the blocker being pushed outward by the cover.

Please refer to both FIG. 11 and FIG. 12. The cam portion 225 has a first inclined surface 226 and the blocker 101 has a second inclined surface 103 at the end of the blocker 101 that abuts against the cam portion 225. The cam portion 225 rotates along with the cover 22 when the cover 22 rotates relative to the housing 21 to the completely closed position; meanwhile, the blocker 101 is biased by the spring device 102 toward the cam portion 225 and fully retracts inside the foot 11', as shown in FIG. 11. In such condition as in FIG. 11, the child seat 10 is allowed to be mounted to the frame body 4. Please turn to FIG. 12. As the cover 22 rotates relative to the housing 21 contrarily to the opened position, the first inclined surface 226 of the cam portion 225 abuts against the second inclined surface 103 of the blocker 101 and pushes the blocker 101 to move along direction N to reach out of the foot 11'. In such condition as shown in FIG. 12 (and in FIG. 10), the blocker 101 reaching out of the foot 11' withstands the frame body 4 as the child seat 10 is to be mounted to the frame body 4 from above the front leg frame 41 toward the supporting frame 132 and prevents the child seat 10 from mounting to the frame body 4. The blocker 101 of such anti-pseudo-engaging device is designed to retract inside the foot 11' only when the cover 22 rotates to the completely closed position, which in other words, part of the blocker 101 always reaches out of the foot 11' as the cover 22 is set at either the opened position or any other incompletely closed position so as to prevent the child seat 10 from mounting to the frame body 4 mistakenly.

Figure 13:
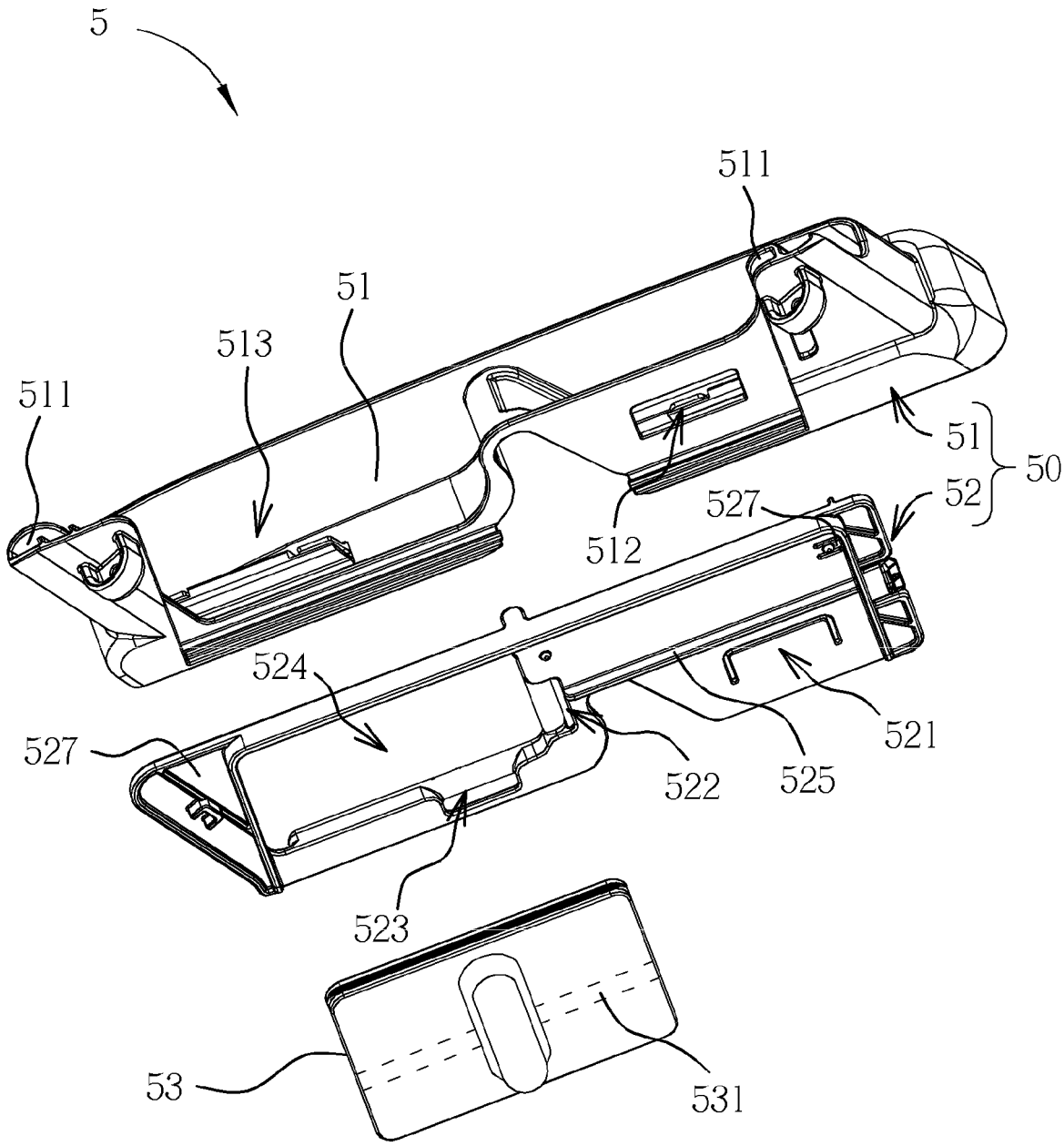
FIG. 13 is a schematic diagram of an exploded view of the safety belt storage assembly according to a second embodiment of the present invention.
Figure 14:
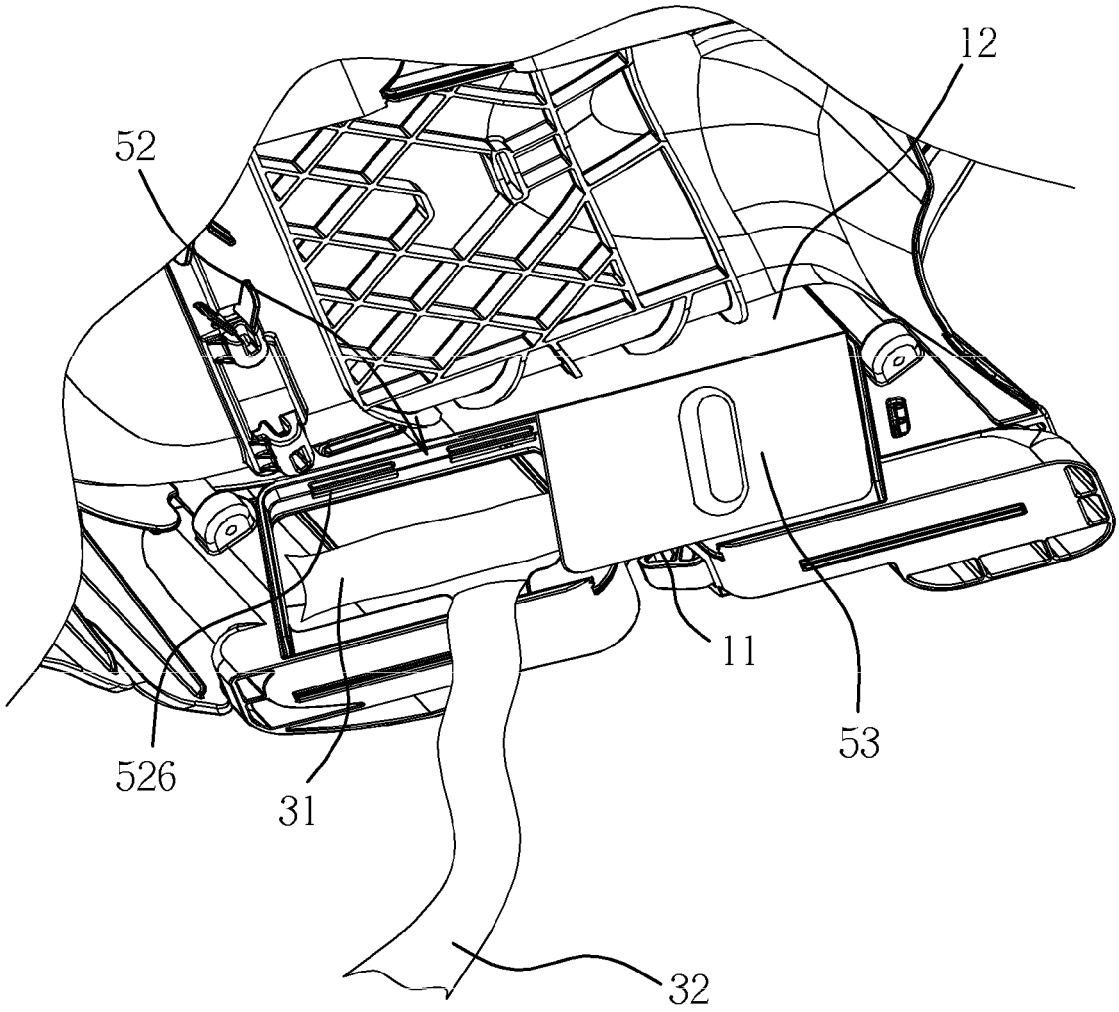
FIG. 14 is a schematic diagram of the safety belt storage assembly being configured to the opened state for the child seat.
Figure 15:
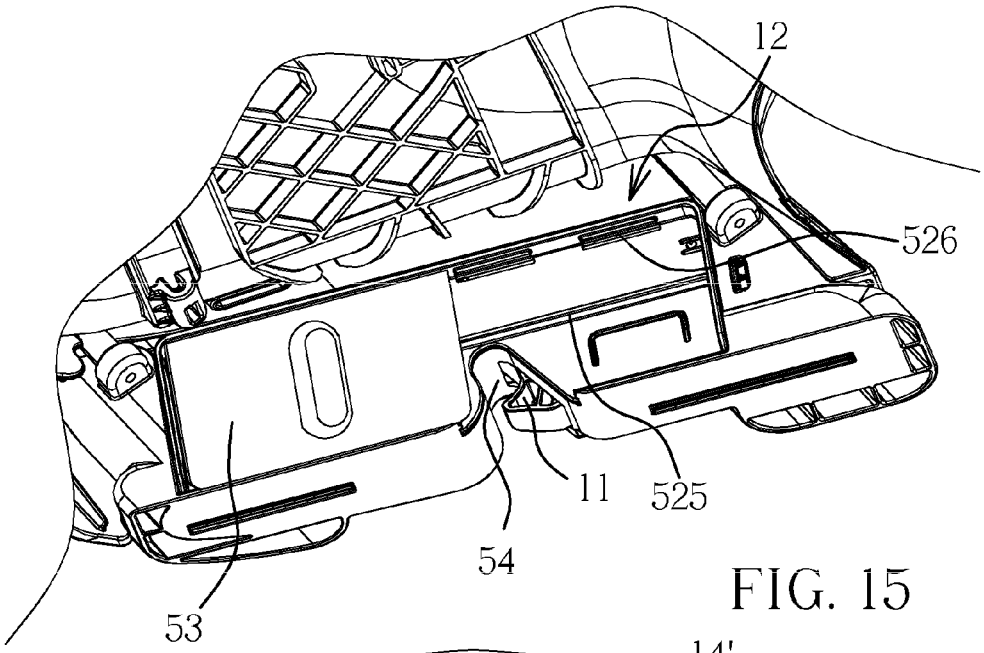
FIG. 15 is a schematic diagram of the safety belt storage assembly being configured to the closed state for the child seat.

Please refer to FIG. 13 to FIG. 15. FIG. 13 is a schematic diagram of an exploded view of the safety belt storage assembly 5 according to a second embodiment of the present invention, and FIG. 14 and FIG. 15 are schematic diagrams of the safety belt storage assembly 5 being configured to the opened state and the closed state for a child seat 12 respectively. In this embodiment, the safety belt storage assembly 5 is mounted to the bottom of the child seat 12 and includes a housing 50, a cover 53, a first safety belt set 31, and a second safety belt set 32, wherein the housing 50 is composed of a supporting base 51 and a connecting base 52. The housing 50 of this embodiment may work as the foot 11' of the first embodiment, providing support and the height for the child seat 12 when the child seat 12 is placed and fastened to an adult chair to serve as a booster. In FIG. 13, the connecting base 52 is plate-shaped and has an opening 524, a first slot 522 and a second slot 523 that are disposed around the opening 524 and perpendicular to each other, a resilient protrusion 521, and wings 527 disposed at two sides respectively. The supporting base 51 has a space 513, two engaging slots 511 corresponding to the two wings 527 of the connecting base 52 respectively, and a coupling slot 512. The wings 527 of the connecting base 52 slide and engage with the engaging slots 511 respectively and the resilient protrusion 521 of the connecting base 52 is engaged with the coupling slot 512 so as to secure the connecting base 52 to the supporting base 51. The first safety belt set 31 includes a strap, and a buckle that connects to the strap. One end of the strap of the first safety belt set 31 connects to the first slot 522. The second safety belt set 32 also includes a strap, and a buckle that connects to the strap. One end of the strap of the second safety belt set 32 connects to the second slot 523. The first safety belt set 31 and the second safety belt set 32 can be stored in the space 513. The cover 53 is slidably mounted to the connecting base 52 and movable between an opened position and a closed position. The cover 53 is guided by a rib 526 on the connecting base 52 as shown in FIG. 15. As the cover 53 slides to the opened position as shown in FIG. 14, the opening 524 is uncovered, and as the cover 53 slides to the closed position as shown in FIG. 15, the opening 524 is covered by the cover 53. The connecting base 52 further has a rib 525 that works with a guiding track 531 of the cover 53. With the rib 525 and the guiding track 531, the cover 53 is confined to only slide on the connecting base 52 along the direction the rib 525 and the guiding track 531 are disposed.

In the second embodiment, an engaging recess 54 is formed at the bottom of the housing 50 in order that the child seat 12 is engaged with the supporting frame 132 of the frame body 4 and together to serve as a high chair 100. On the other hand, when the child seat 12 is detached from the supporting frame 132 to provide as a booster, the cover 53 may be moved to the opened position as shown in FIG. 14, and the first safety belt set 31 and the second safety belt set 32 may reach out of the space 513 of the housing 50, and meanwhile, the cover 53 is blocking off the engaging recess 54 of the housing 50 to prevent accidental installation of the child seat 12 to the frame body 4 while the cover 53 is still at the opened position. If the cover 53 is desired to be converted to the closed position as shown in FIG. 15, the first safety belt set 31 and the second safety bet set 32 must already be stored in the space 513. Since the engaging recess 54 is no longer blocked off by the cover 53, the child seat 12 is allowable to be mounted to the frame body 4 and together serve as a high chair 100.

Figure 16:
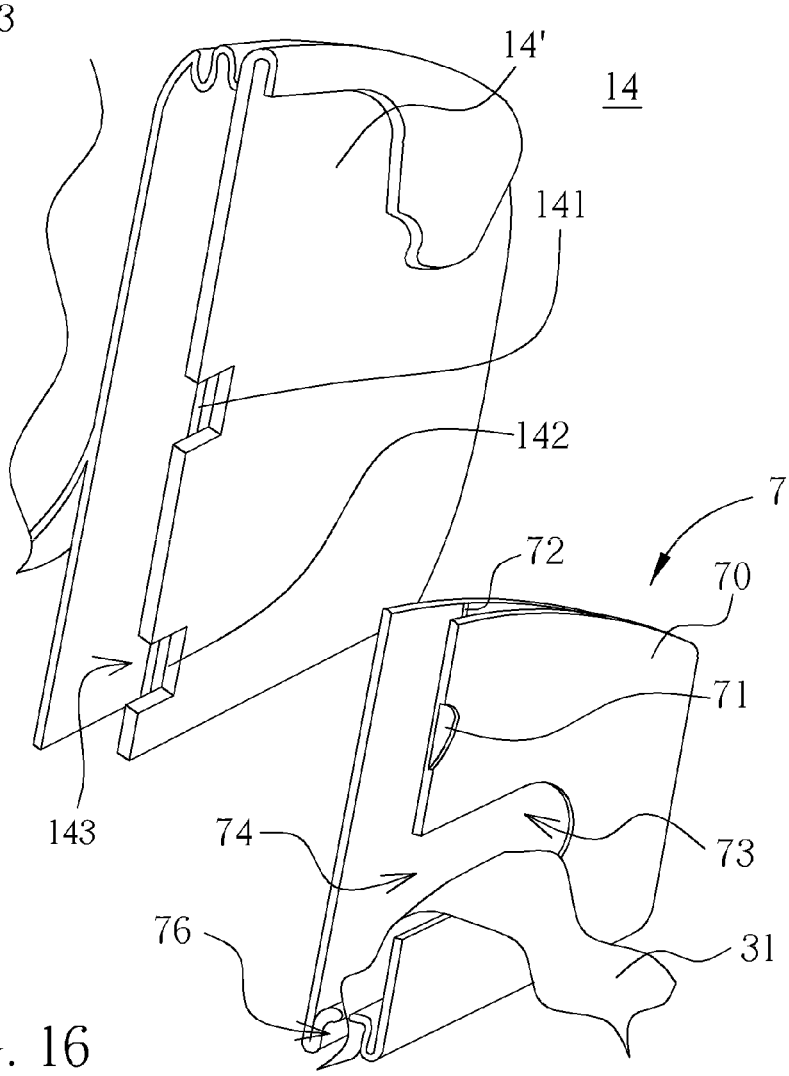
FIG. 16 is a schematic diagram of a safety belt storage assembly according to a third embodiment of the invention.
Figure 18:
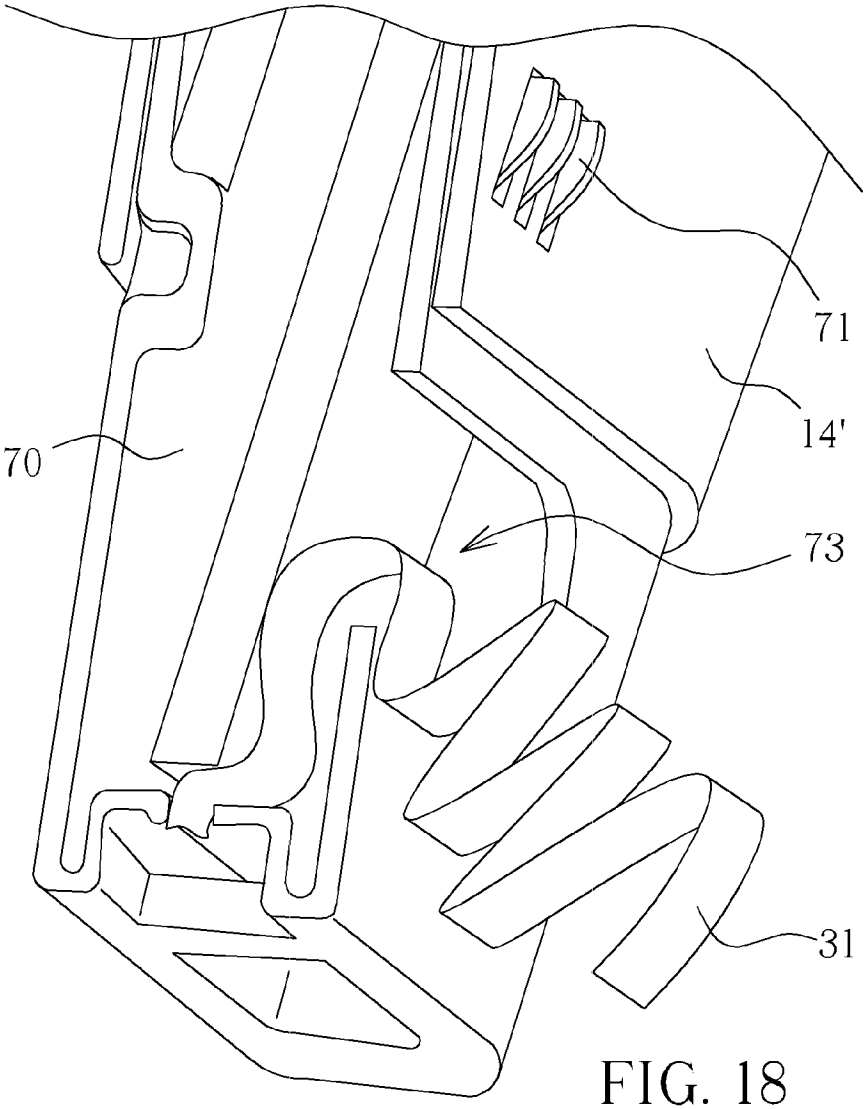
FIG. 18 is a schematic diagram showing the safety belt storage assembly according to the third embodiment at an opened state.
Figure 17:
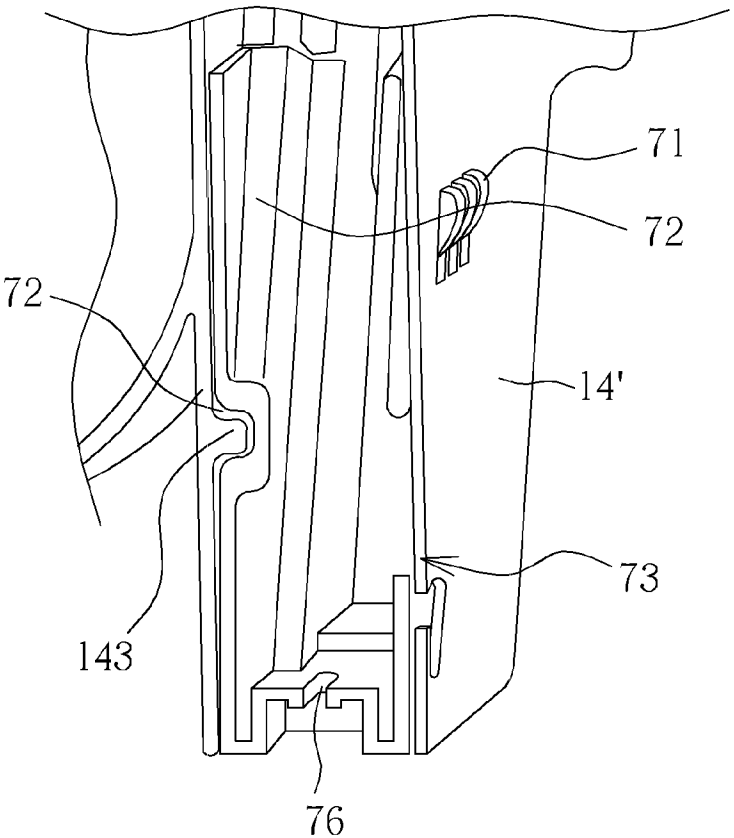
FIG. 17 is a schematic diagram showing the safety belt storage assembly according to the third embodiment coupled to one side of a main body of a child seat and at a closed state.
Figure 19:
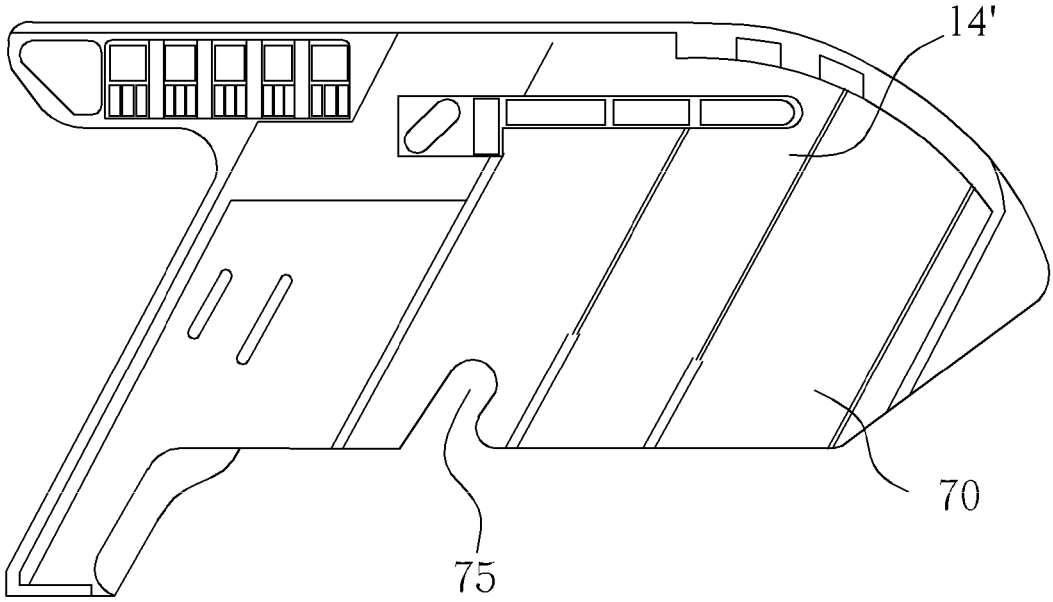
FIG. 19 is a schematic diagram of the side view of the safety belt storage assembly according to the third embodiment configured at the closed state.
Figure 20:
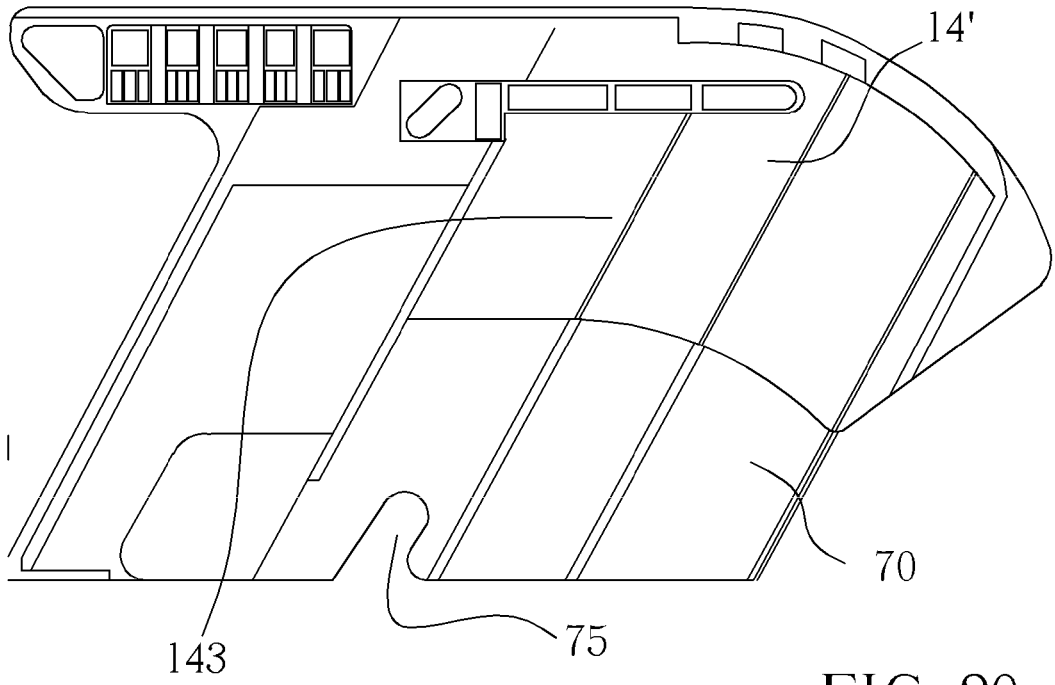
FIG. 20 is a schematic diagram of the side view of the safety belt storage assembly according to the third embodiment configured at the opened state.

Please refer to FIG. 16 to FIG. 20. FIG. 16 is a schematic diagram of a safety belt storage assembly 7 according to a third embodiment of the invention, FIG. 17 is a schematic diagram showing the safety belt storage assembly 7 at a closed state at one side of a main body 14' of a child seat 14, FIG. 18 is a schematic diagram showing the safety belt storage assembly 7 at an opened state at one side of the main body 14' of the child seat 14, and FIG. 19 and FIG. 20 are schematic diagrams of the side view of the storage of the safety belt storage assembly 7 configured at the closed state and at the opened state respectively. In this embodiment, the safety belt storage assembly 7 is slidably mounted to one side of the main body 14' of the child seat 14. The safety belt storage assembly 7 is moveable along a vertical direction relative to the main body 14'. The safety belt storage assembly 7 may also serve as the foot 11' of the second embodiment that supplies support and the height for the child seat 14 when the child seat 14 is placed and fastened to an adult chair to serve as a booster. In FIG. 16, the main body 14' of the child seat 14 has a first track 143, a first retaining part 141, and a second retaining part 142. The safety belt storage assembly 7 includes a housing 70, and a first safety belt set 31, which connects to the housing 70. The housing 70 has a space 74, a coupling portion 71, a second track 72, and a first slot 76. The housing 70 is slidable along the main body 14' via the matching between the second track 72 of the housing 70 and the first track 143 of the main body 14'. The housing 70 is movable between a closed position as shown in FIG. 17 where the coupling portion 71 is engaged with the first retaining part 141, and an opened position as shown in FIG. 18 where the coupling portion 71 is engaged with the second retaining part 142. In this embodiment, the first track 143 is a protruding rib and the second track 72 is a sliding ditch, or the first track 143 and the second track 72 may be configured contrarily. The first safety belt set 31 connects and is secured to the first slot 76 at the bottom of the housing 70 with one end and may be stored in the space 74.

Figure 21:
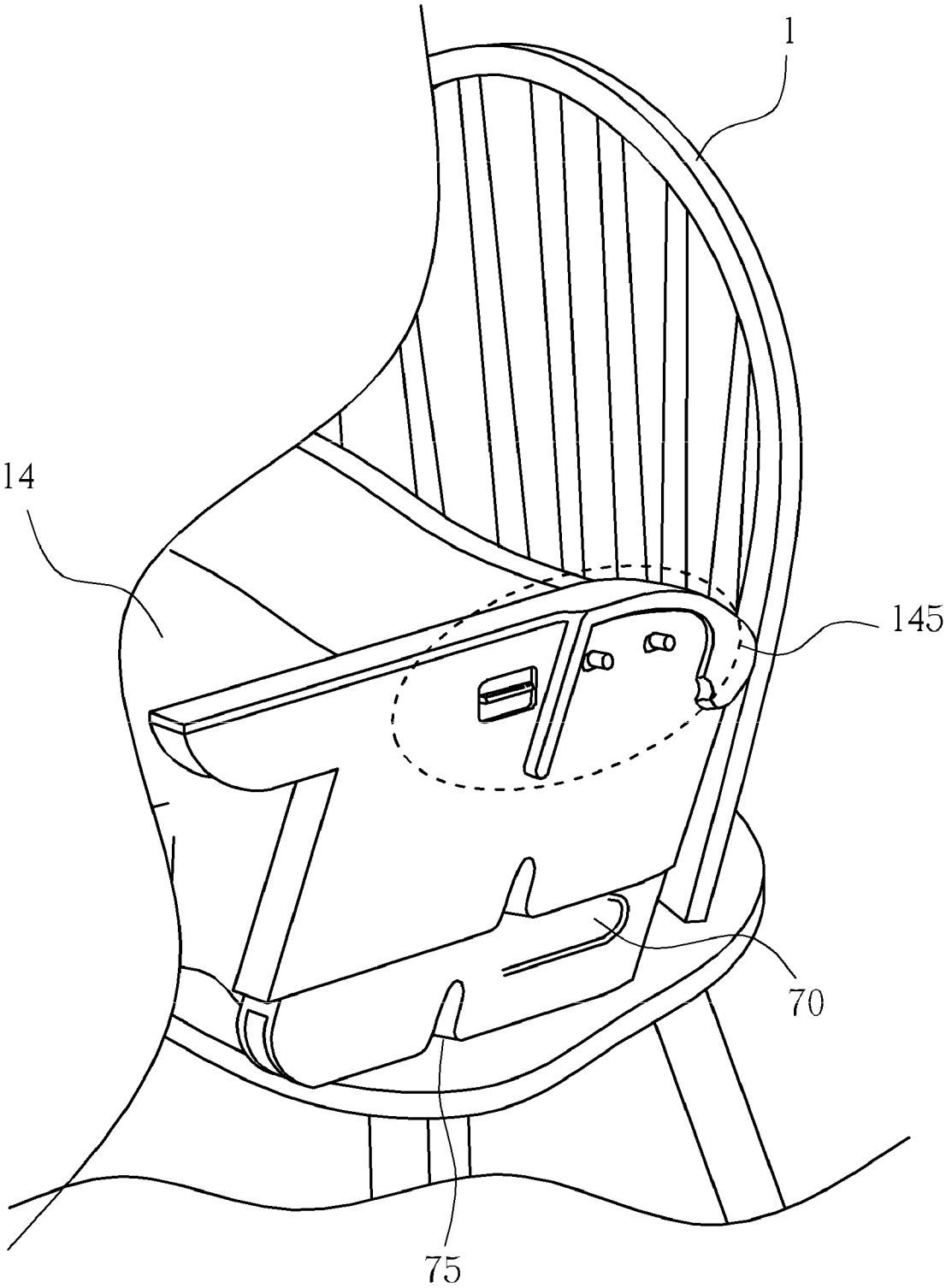
FIG. 21 is a schematic diagram of the child seat according to the third embodiment mounted to an adult chair.

As illustrated in FIG. 17 and FIG. 18, when the housing 70 slides on the main body 14' until the coupling portion 71 is engaged with the first retaining part 141, the housing 70 is configured at the closed position, and the first safety belt set 31 is fully stored in the space 74 of the housing 70. An engaging recess 75 is further disposed at the bottom of the main body 14' and the housing 70 of the child seat 14, which is shown in FIG. 19 and FIG. 20. The child seat 14 further includes a coupling assembly 145 at both sides, which is shown in FIG. 21. When the child seat 14 is mounted to the frame body 4 to work together as a high chair, the supporting frame 132 is located in the engaging recess 75 and is secured to child seat 14 by the coupling portion (not shown in the figure) of the coupling assembly 145. The first safety belt set 31 is fully stored in the space 74 to avoid safety issue at the same time. As the child seat 14 is removed from the frame body 4 to serve as a booster, it is shown in FIG. 18 that the housing 70 first disengages from the first retaining part 141 at the closed position and slides on the main body 14' until the coupling portion 71 has engaged with the second retaining part 142 and the housing 70 is now configured at the opened position. When the housing 70 is at the opened position, the first safety belt set 31 is capable of reaching out of the space 74 and passing through the opening 73. The child seat 14 is ready to be fastened to an adult chair thereafter. Please refer to FIG. 19, FIG. 20, and FIG. 21. When the safety belt storage assembly 7 is configured at the opened state as shown in FIG. 20 and FIG. 21, the housing 70 has relative lower position to the main body 14', meaning that the child seat 14 has higher height. The engaging recess 75 of the housing 70 moves away the coupling portion of the coupling assembly 145 at both sides of the main body 14' so that the child seat 14 is unable to be secured to the supporting frame 132. It means that only when the first safety belt set 31 is fully stored in the space 74 the child seat 14 could be mounted to the frame body 4. Also in FIG. 20 or FIG. 21, when the safety belt storage assembly 7 is at the opened state, the first safety belt set 31 can be pulled out of the space 74 for fastening the child seat 14 to an adult chair, and the lowered safety belt storage assembly 7 also supports and provides the height for the child seat 14.

Figure 22:
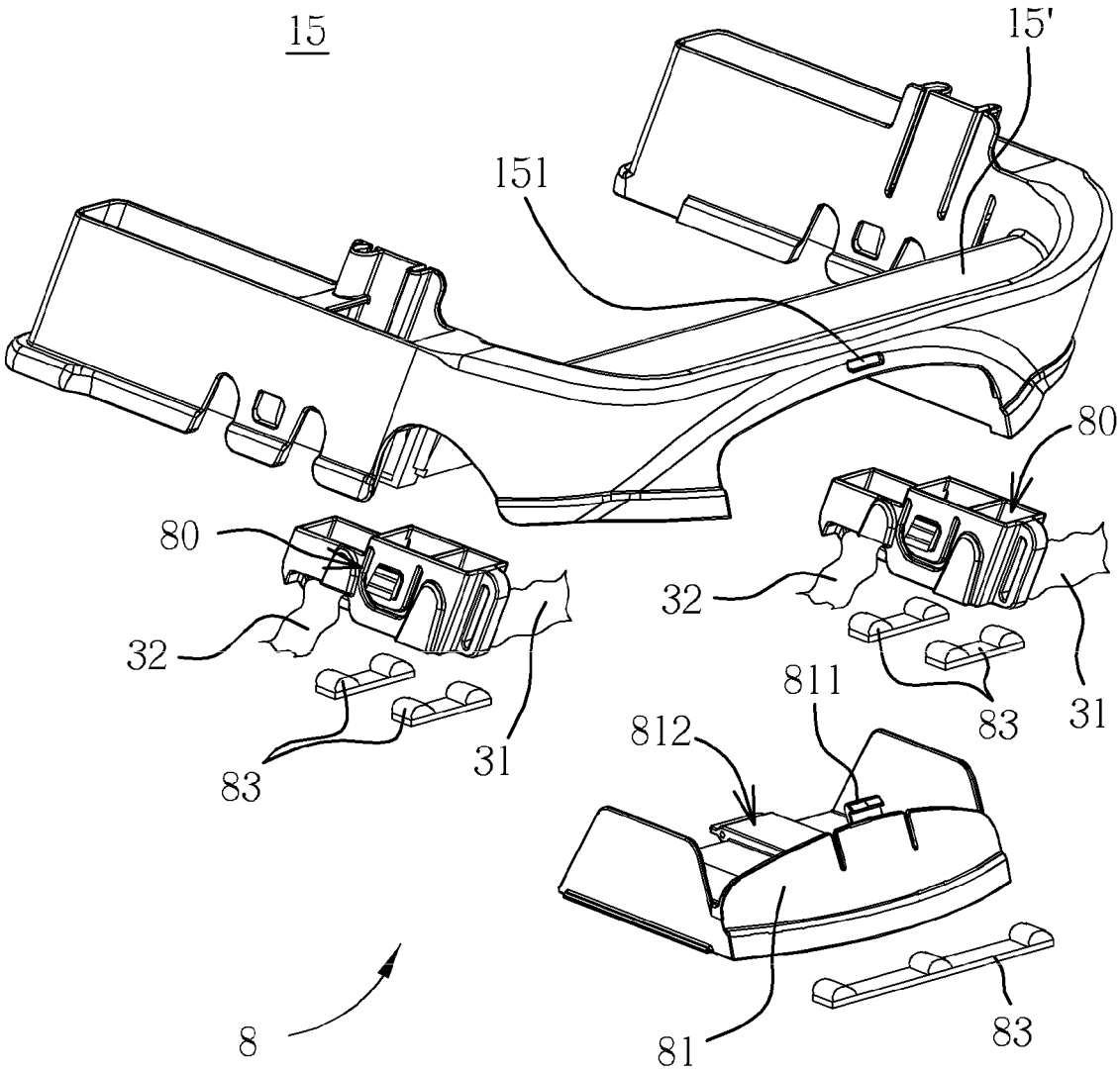
FIG. 22 is a schematic diagram of an exploded view of each component of a safety belt storage assembly according to a fourth embodiment of the invention.
Figure 23:
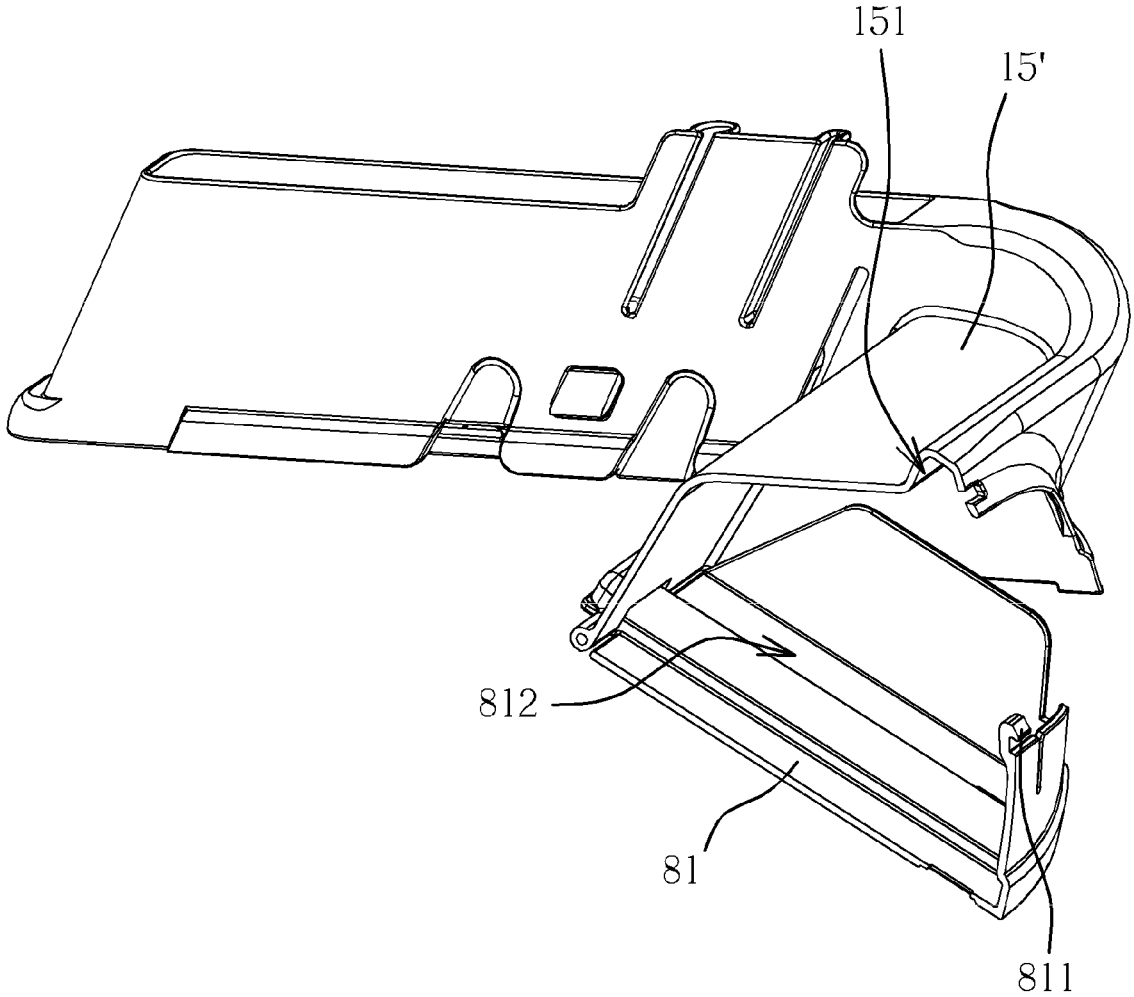
FIG. 23 is a schematic diagram showing a cross-section view of a housing of the safety belt storage assembly according to the fourth embodiment mounted at the back of the child seat and at an opened position.
Figure 24:
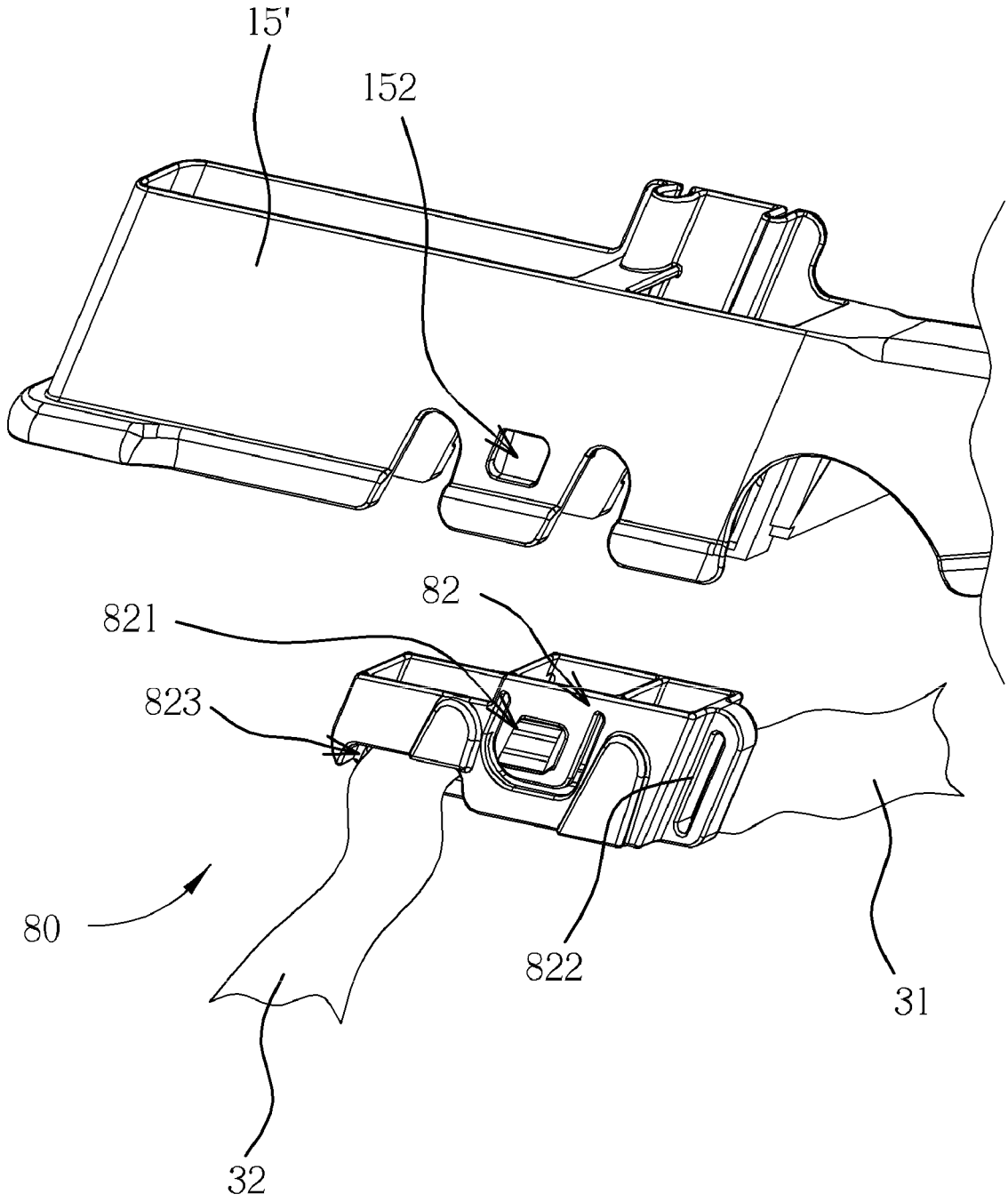
FIG. 24 is a schematic diagram showing a safety belt set of the safety belt storage assembly according to the fourth embodiment at one side of the child seat.
Figure 25:
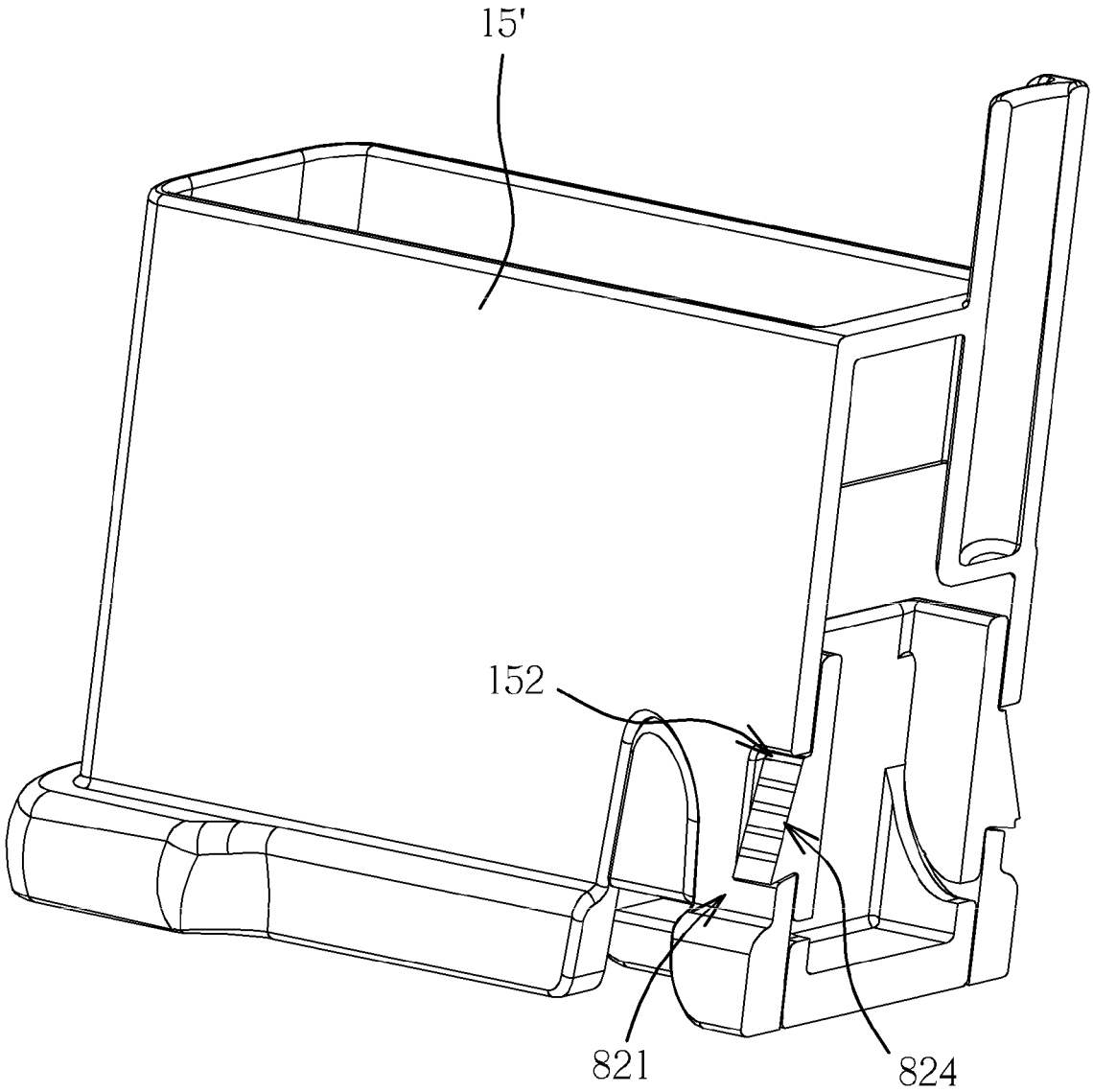
FIG. 25 is a schematic diagram showing a partial view of the safety belt set of the safety belt storage assembly according to the fourth embodiment.
Figure 26:
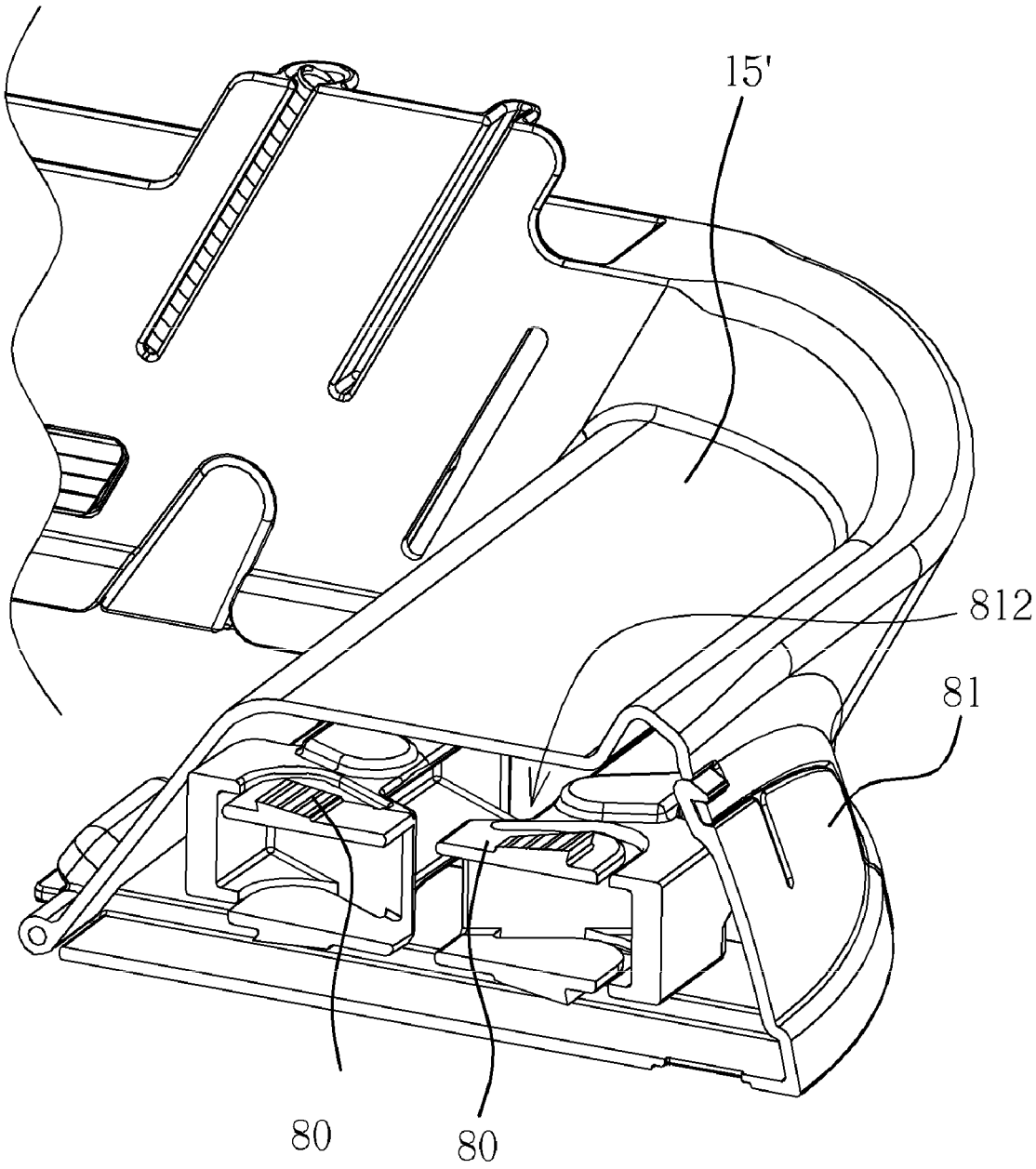
FIG. 26 is a schematic diagram showing a cross-section view that two safety belt sets are stored in the housing of the safety belt storage assembly according to the fourth embodiment.

Please refer to FIG. 22 to FIG. 26. FIG. 22 is a schematic diagram of an exploded view of a safety belt storage assembly 8 according to a fourth embodiment of the invention, FIG. 23 is a schematic diagram showing a cross-section view of a housing 81 of the safety belt storage assembly 8 mounted at the back of a main body 15' of a child seat 15 and at an opened position, FIG. 24 is a schematic diagram showing a safety belt set 80 of the safety belt storage assembly 8 at one side of the main body 15' of the child seat 15, FIG. 25 is a schematic diagram showing a partial view of the safety belt set 80 of the safety belt storage assembly 8 mounted to the side of the main body 15' of the child seat 15, and FIG. 26 is a schematic diagram showing a cross-section view that two safety belt sets

80 are stored in the housing 81 of the safety belt storage assembly 8. In this embodiment, the safety belt storage assembly 8 is configured at the back of the main body 15' of the child seat 15 and includes a housing 81 and two safety belt sets 80. The housing 81 is mounted to the main body 15' of the child seat 15 and is convertible relative to the main body 15' of the child seat 15 between an opened state as shown in FIG. 23, and a closed state as shown in FIG. 26. A space 812 is formed therein when the housing 81 is mounted to the main body 15' of the child seat 15 and is used to store the two safety belt sets 80 as the housing 81 is converted to the closed state. The housing 81 may further be secured to the main body 15' of the child seat 15 by engaging a coupling portion 811 of the housing 81 with a coupling slot 151 of the main body 15'. FIG. 24 shows that the safety belt set 80 includes a connecting seat 82, a first safety belt set 31, and a second safety belt set 32. Each connecting seat 82 has a first slot 822 and a second slot 823 perpendicular to each other. The first safety belt set 31 connects to the first slot 822 of one connecting seat 82 with one end and connects to the first slot 822 of the other connecting seat 82 with the other end. The second safety belt set 32 connects to the second slot 823 of one connecting seat 82 with one end and connects to the second slot 823 of the other connecting seat 82 with the other end. Each connecting seat 82 is detachably mounted to the side of the main body 15' of the child seat 15 by engaging a resilient protrusion 821 of the connecting seat 82 with a corresponding coupling slot 152 at the side of the main body 15, wherein the engaging between the resilient protrusion 821 and the coupling slot 152 is illustrated in FIG. 25. Additionally, the resilient protrusion 821 of the connecting seat 82 has an inclined surface 824 that helps engaging with the coupling slot 152.

If the child seat 15 is used as the seat part of a high chair by mounting to the supporting frame 132, the safety belt sets 80 is fully stored in the space 812 of the housing 81. If the child seat 15 needs to be detached from the supporting frame 132 to serve as a booster, the safety belt sets 80 may be taken out of the space 812 and mounted to the main body 15' by engaging the connecting seat 82 to the main body 15'; meanwhile, the first safety belt set 31 and the second safety belt set 32 are used to fasten the child seat 15 to an adult chair. Additionally, several slid-proof pads 83 may also be disposed at the bottom of the housing 81 and the connecting seats 82 as shown in FIG. 22 that contact with the surface of the adult chair for further preventing the child seat 15 from skidding on the adult chair.

To detach the safety belt sets 80 from the main body 15', simply pressing the resilient protrusion 821 of the connecting seats 82 at both sides makes the resilient protrusion 821 to disengage from the coupling slot 152 and the safety belt set 80 can be detached thereafter. Then pressing the coupling portion 811 of the housing 81 will disengage the coupling portion 811 from the coupling slot 151 of the main body 15' and the housing 81 is rotatable to expose the space 812. The two safety belt sets 80 are stored in the space 812 and the housing 81 rotates to fully close again.

Figure 27:
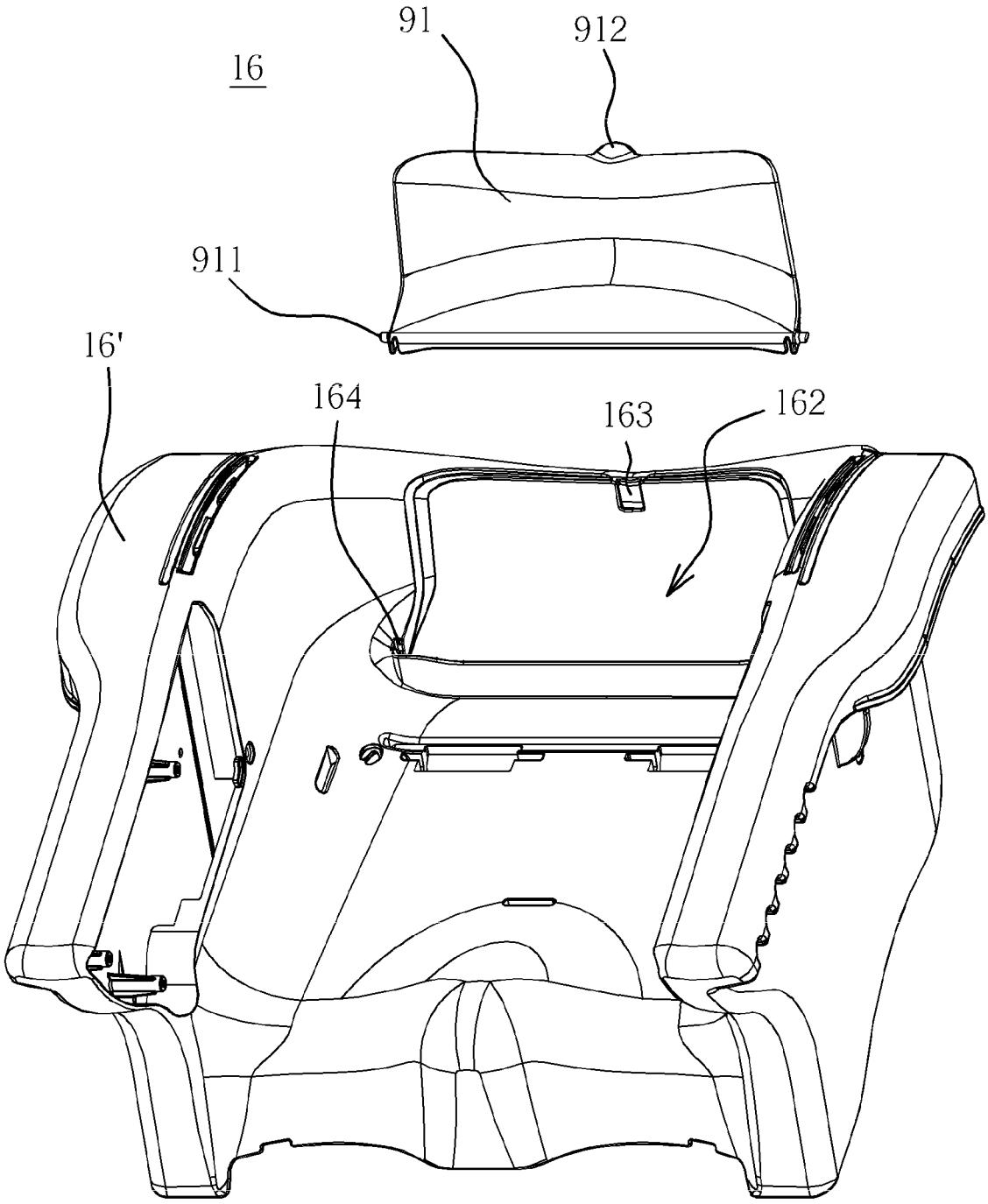
FIG. 27 is a schematic diagram of a safety belt storage assembly according to a fifth embodiment of the invention and a main body of a child seat.
Figure 28:
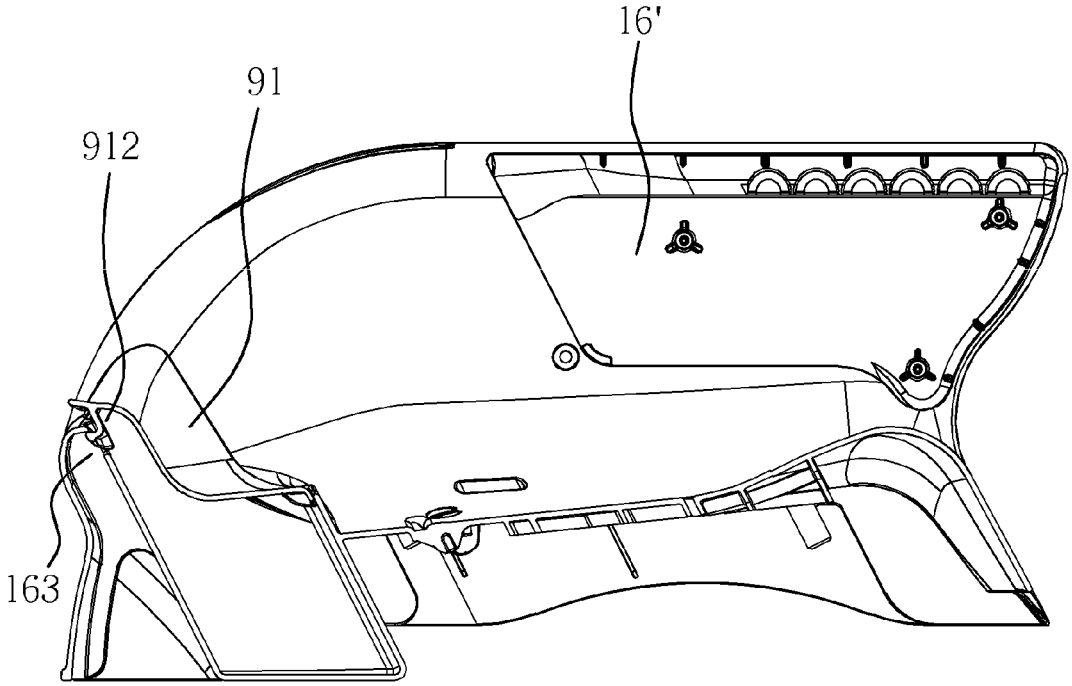
FIG. 28 is a schematic diagram showing a cross-section view of the storage configured at a closed state at the back of the main body according to the fifth embodiment.
Figure 29:
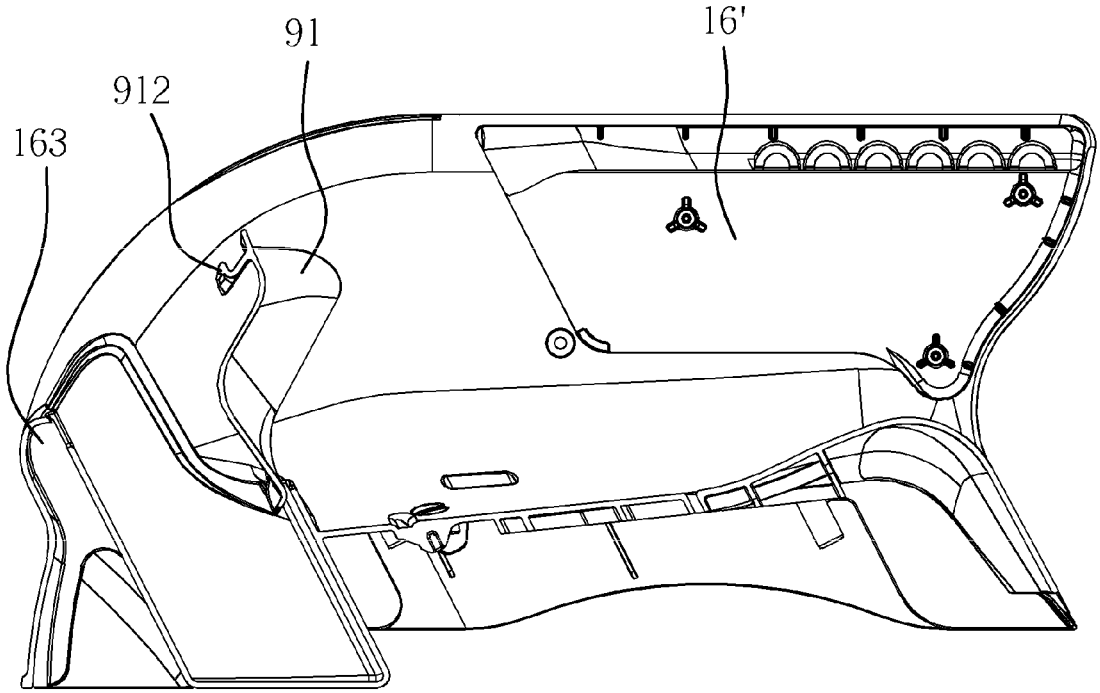
FIG. 29 is a schematic diagram showing a cross-section view of the storage configured at an opened state according to the fifth embodiment.
Figure 30:
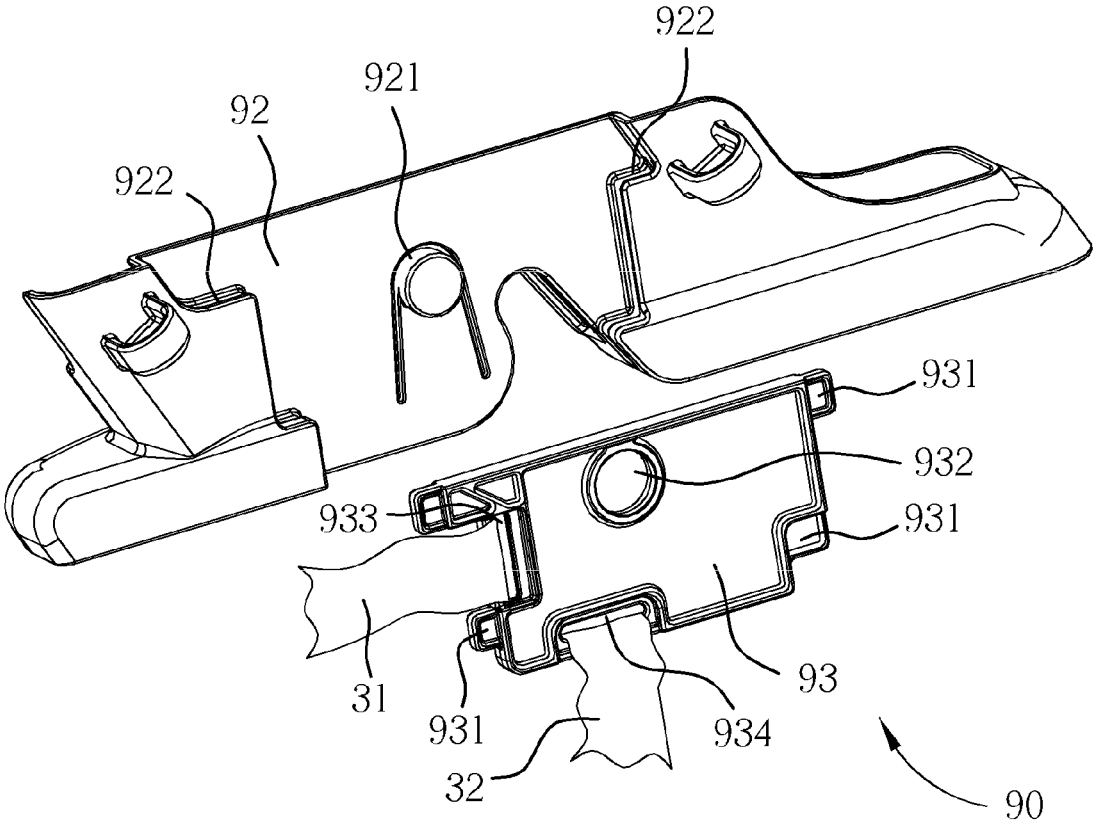
FIG. 30 is a schematic diagram of an exploded view of each component of a safety belt set according to the fifth embodiment.
Figure 31:
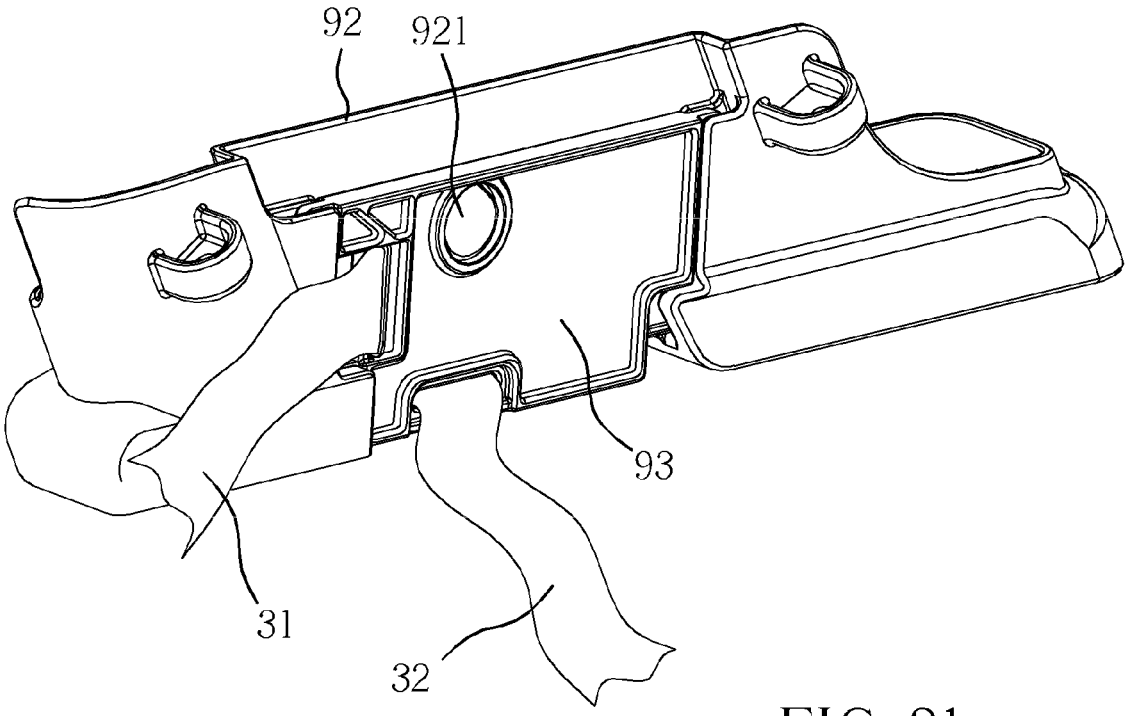
FIG. 31 is a schematic diagram showing the assembled safety belt set according to the fifth embodiment.

Please refer to FIG. 27 to FIG. 31. FIG. 27 is a schematic diagram of a safety belt storage assembly according to a fifth embodiment of the invention, along with a main body 16' of a child seat 16, FIG. 28 is a schematic diagram showing a cross-section view of a storage (including the cover 91 and part of the main body 16') configured at a closed state at the back of the main body 16', FIG. 29 is a schematic diagram showing a cross-section view of the storage configured at an opened state at the back of the main body 16', FIG. 30 is a schematic diagram of an exploded view of a safety belt set 90 of the safety belt storage assembly, and FIG. 31 is a schematic diagram showing the assembled safety belt set 90. In this embodiment, the safety belt storage assembly is configured at the back of the main body 16' of the child seat 16 and includes a cover 91 and two safety belt sets 90. The cover 91 is mounted to the main body 16' of the child seat 16 by engaging the pivoting shafts 911 with coupling slots 164 of the main body 16' and is pivotable relative to the main body 16' of the child seat 16 between a closed position as shown in FIG. 28 and an opened position as shown in FIG. 29. A space 162 is formed therein when the cover 91 is mounted to the main body 16' of the child seat 16 and is used to store the two safety belt sets 90 therein when the cover 91 is converted to the closed position. The cover 91 may further be secured to the main body 16' of the child seat 16 by engaging a coupling portion 912 of the cover 91 with a coupling slot 163 of the main body 16', wherein the coupling portion 912 is resilient in this embodiment. FIG. 28 shows that when the cover 91 is at the closed position, pressing to deform the coupling portion 912 will disengage the coupling portion 912 from the coupling slot 163 and make the cover 91 to rotate to the opened position as shown in FIG. 29. The safety belt sets 90 or other stuff may be stored in the space 162 therein. Pressing the cover 91 will engage the coupling portion 912 with the coupling slot 163 to close the cover 91 again.

FIG. 30 shows that the safety belt storage assembly includes one safety belt set 90 mounted at each side of the main body 16', each safety belt set 90 includes a connecting seat 93, a first safety belt set 31, and a second safety belt set 32. Each connecting seat 93 has a first slot 933 and a second slot 934 perpendicular to each other. The first safety belt set 31 connects to the first slot 933 of one connecting seat 93 with one end and connects to the first slot 933 of the other connecting seat 93 with the other end. The second safety belt set 32 connects to the second slot 934 of one connecting seat 93 with one end and connects to the second slot 934 of the other connecting seat 93 with the other end. Each connecting seat 93 is detachably mounted to a corresponding supporting base 92 (or the seat coupling device 11 in the previous embodiment) at the side of the main body 16' by engaging each wing 931 at the four corners of the connecting seat 93 with a corresponding engaging slot 922 at both sides of the supporting base 92. Additionally, a resilient protrusion 921 of the supporting base 92 is used to engage with a coupling slot 932 of the connecting seat 93 for further retaining the connecting seat 93 to prevent the connecting seat 93 from moving in all direction when mounting to the supporting base 92. The connecting seat 93 mounted to the supporting base 92 is shown in FIG. 31. When the child seat 16 is to mount to the supporting frame 132 and serve as the seat part of a high chair, the safety belt sets 90 may be stored in the space 162 first. If the child seat 16 is detached from the supporting frame 132 and needs to be used as a booster, the operation is the same as the fifth embodiment as described for the fourth embodiment. The supporting bases 92 also work as the feet 11' aforementioned for providing support and the height for the child seat 16. If the connecting seat 93 is to be detached from the main body 16' of the child seat 16, simply pressing the resilient protrusion 921 of the supporting bases 92 at both sides makes the resilient protrusion 921 to disengage from the coupling slot 932 and the connecting seats 93 can be detached.

According to the embodiments of the invention, a safety belt storage assembly and a child seat equipped with such safety belt storage assembly are disclosed. When the storage is mounted to the main body of the child seat, the storage of the safety belt storage assembly may be selectively configured between an opened state and a closed state by operating the storage's cover relative to its housing (or the housing relative to the main body of the child seat). When the storage of the safety belt storage assembly is configured at the opened state, the safety belt set stored within the housing can be taken out and further used to fasten the child seat to an adult chair. The opened state storage of the safety belt storage assembly further prevents the child seat from mounting on the frame body. When the safety belt set is stored in the housing, the storage of the safety belt storage assembly can be configured to the closed state and the child seat is allowed to be mounted to the frame body.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A safety belt storage assembly, comprising:

a housing comprising a space and an opening;

a cover mounted to the housing and movable relative to the housing between an opened position and a closed position that covers the opening; and a safety belt set mounted to the housing, wherein the safety belt set is stored in the space when the cover is configured at the closed position and the safety belt set is capable of reaching out of the space through the opening when the cover is configured at the opened position, the safety belt set comprising a first safety belt set and a second safety belt set mounted to the housing respectively.

2. The safety belt storage assembly of claim 1, wherein the first safety belt set and the second safety belt set are secured to the housing and are unparallel to each other.

3. The safety belt storage assembly of claim 1, wherein the cover pivots to the housing such that the cover is rotatable relative to the housing.

4. The safety belt storage assembly of claim 3, comprising a torsion spring configured between the cover and the housing for biasing the cover toward the opened position.

5. The safety belt storage assembly of claim 1, wherein the housing further comprises a coupling slot and the cover further comprising a coupling portion for engaging with the coupling slot and keeping the cover at the closed position.

6. The safety belt storage assembly of claim 1, wherein the cover is slidably mounted to the housing.

7. A child seat detachably mounted to a frame body, comprising:

a storage comprising a space, wherein the storage is convertible between a closed state and an opened state; and a safety belt set;

wherein when the child seat is mounted to the frame body, the storage is at the closed state and the safety belt set is stored in the space, and when the child seat is detached from the frame body, the storage is moved to the opened state such that the child seat is capable of fastening to an adult chair via the safety belt set.

8. The child seat of claim 7, wherein the safety belt set is secured to the storage.

9. The child seat of claim 8, wherein the safety belt set comprises a first safety belt set and a second safety belt set secured to the storage and is unparallel to each other.

10. The child seat of claim 7, further comprising a seat coupling device detachably coupling with the frame body, wherein the storage comprises:

a housing comprising the space and an opening; and a cover mounted to the housing and movable relative to the housing to cover the opening or uncover the opening;

wherein when the storage is in the opened state, the cover uncovers the opening and locates at the path where the seat coupling device coupling with the frame body, thereby preventing the child seat from mounting to the frame body.

11. The child seat of claim 10, wherein the cover is rotatably mounted to the housing.

12. The child seat of claim 10, wherein the cover is slidably mounted to the housing.

13. The child seat of claim 10, wherein the seat coupling device comprises an engaging recess configured at the housing for engaging with a supporting frame of the frame body.

14. The child seat of claim 10, wherein the cover further comprises a protruding edge wherein when the child seat is mounted to the frame body, the frame body abuts against the protruding edge so that the cover is kept at the position covering the opening and incapable of moving relative to the housing.

15. The child seat of claim 10, comprising:

a main body;

a cam portion formed at the outer surface of the cover;

a blocker moveably mounted to the main body, wherein one end of the blocker abuts against the cam portion and the other end of the blocker is retractable at the main body; and a spring device mounted between the main body and the blocker for biasing the blocker to retract inside the main body.

16. The child seat of claim 7, wherein the child seat comprises a main body comprising a first retaining part and a second retaining part, the storage comprises a housing slidably mounted to the main body, the housing comprises a space, an opening and a coupling portion, and the coupling portion is selectively engaging with the first retaining part where the storage is retained at the closed state or the second retaining part where the storage is retained at the opened state.

17. The child seat of claim 16, wherein the housing moves along a vertical direction relative to the main body.

18. The child seat of claim 7, wherein the child seat comprises a main body and a foot positioned under the main body, and the storage is mounted to the foot.

19. The child seat of claim 7, wherein the safety belt set comprises:

a connecting seat detachably mounted to a main body of the child seat; and a first safety belt set connecting to the connecting seat.

20. The child seat of claim 19, wherein the connecting seat comprises a resilient protrusion for engaging with a coupling slot of the main body so as to mount the connecting seat to the main body.

21. A safety belt storage assembly, comprising:

a housing comprising a space and an opening;

a cover slidably mounted to the housing and movable relative to the housing between an opened position and a closed position that covers the opening; and a safety belt set mounted to the housing, wherein the safety belt set is stored in the space when the cover is configured at the closed position and the safety belt set is capable of reaching out of the space through the opening when the cover is configured at the opened position.

* * * * *